US008222508B2

(12) United States Patent
Ide et al.

(10) Patent No.: US 8,222,508 B2
(45) Date of Patent: Jul. 17, 2012

(54) TONE SIGNAL CREATING APPARATUS AND METHOD

(75) Inventors: Kensuke Ide, Hamamatsu (JP); Norihisa Aoki, Hamamatsu (JP); Toshifumi Kunimoto, Hamamatsu (JP); Fumitsugu Ohtaka, Hamamatsu (JP); Tadashi Okano, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 56 days.

(21) Appl. No.: 12/748,241

(22) Filed: Mar. 26, 2010

(65) Prior Publication Data

US 2010/0242710 A1 Sep. 30, 2010

(30) Foreign Application Priority Data

Mar. 30, 2009 (JP) ..... 2009-081719

(51) Int. Cl.
*G10H 1/06* (2006.01)

(52) U.S. Cl. ..... 84/622

(58) Field of Classification Search ..... 84/622
See application file for complete search history.

(56) References Cited

U.S. PATENT DOCUMENTS

2008/0060501 A1* 3/2008 Nakazono ..... 84/605
2008/0155529 A1* 6/2008 Kang et al. ..... 717/174

FOREIGN PATENT DOCUMENTS

JP 08-076752 A 3/1996
JP 2003-122368 A 4/2003

OTHER PUBLICATIONS

Yamaha. (2003). "GW50 Guitar Performance Effector Owner's Manual," (English Version), 165 pages.
Yamaha. (2003). "GW50 Guitar Performance Effector Owner's Manual," (Japanese Version), 183 pages.

* cited by examiner

*Primary Examiner* — Jianchun Qin
(74) *Attorney, Agent, or Firm* — Morrison & Foerster LLP

(57) ABSTRACT

In the case where an automatic reading file composed of plural kinds of detailed parameters stored in a transportable storage device whose attachment is detected has been already read in an apparatus, it is determined whether update, to a currently-read automatic reading file, of an automatic reading file stored in a storage section is carried out or not in accordance with a user's instruction, and is controlled so as to carry out a process. Namely, in the case where an automatic reading file has not been read yet, the automatic reading file stored in the storage section is updated to the currently-read automatic reading file without any condition. On the other hand, if an automatic reading file has been already read, the automatic reading file stored in the storage section may be edited on the basis of it.

6 Claims, 11 Drawing Sheets

(5) PERFORMANCE MODE: COMPLETE ASSIGNMENT OF PARAMETER TO ONE CONTROL KNOB

| PRE A : 01 : [EP+AP] | | | 1 [EP01] | | 2 [AP01] |
|---|---|---|---|---|---|
| 1Bass | ——— | ——— | ——— | ——— | ——— |

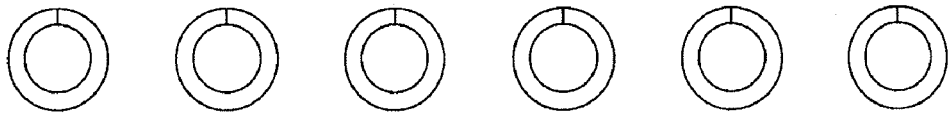

(6) PERFORMANCE MODE: COMPLETE ASSIGNMENT OF PARAMETERS TO ALL CONTROL KNOBS

| PRE A : 01 : [EP+AP] | | | 1 [EP01] | | 2 [AP01] |
|---|---|---|---|---|---|
| 1Bass | 1Decay | 2Release | 2Volume | 2Speed | 2Depth |

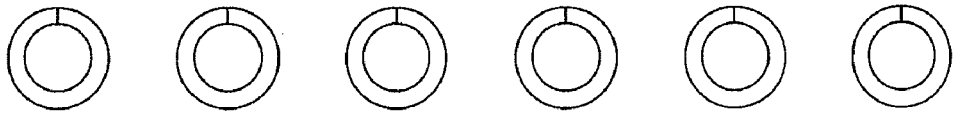

(7) PERFORMANCE MODE: CHANGE PARAMETER VALUE BY CONTROL KNOB OPERATION

| PRE A :01 : [EP+AP] | | | 1 [EP01] | | 2 [AP01] |
|---|---|---|---|---|---|
| 1Bass | 100 | ——— | 2Volume | 2Speed | 2Depth |

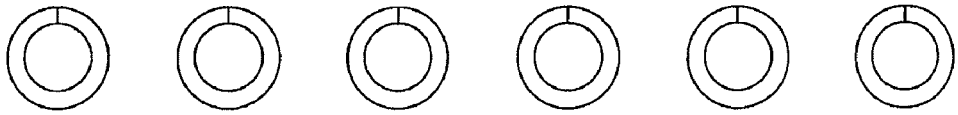

(8) PERFORMANCE MODE: CLEAR ASSIGNED PARAMETERS

| 1Bass | 1Decay | ——— | 2Volume | 2Speed | 2Depth |
|---|---|---|---|---|---|
| 127 | 100 | ——— | 110 | 50 | 127 |

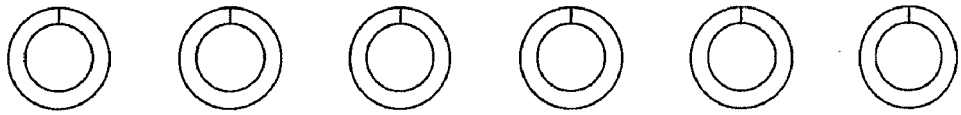

FIG. 13B

TONE SIGNAL CREATING APPARATUS AND METHOD

CROSS-REFERENCE TO RELATED APPLICATION

The present disclosure relates to subject matter contained in Japanese Patent Application No. 2009-081719, filed on Mar. 30, 2009, the disclosure of which is expressly incorporated herein by reference in its entirety.

BACKGROUND OF THE INVENTION

The present invention relates to a tone signal creating apparatus and a method of creating tone signals capable of creating a wide variety of tone signals by virtually simulating signal control processes regarding generation of tone signals, amplification of tone signals and effect impartment to tone signals.

Heretofore, a tone signal creating apparatus and a program that pseudoly or virtually synthesizes tones of a natural musical instrument by carrying out simulation in accordance with a predetermined physical model based on a tone production mechanism (tone signal generation characteristic) of the natural musical instrument on a digital signal control processing device such as a DSP (digital signal processor), or a dedicated hardware device constructed so as to include a discrete circuit, an integrated circuit or a large-scaled integrated circuit, are known. The invention disclosed in Japanese Patent Application Laid-open Publication No. 2003-122368 is one example of such a tone signal creating apparatus.

Further, a wide variety of tone signals can be created by simulating appropriate combination of amplification and effect impartment of tone signals including not only a tone signal generated by simulation, but also a tone signal generated on the basis of actual string vibration in natural musical instruments such as an acoustic piano or electronic musical instruments such as an electronic piano, for example. For that reason, one or more detailed parameter characterizing control characteristics in a plurality of signal processing sections (referred to as "element blocks") that carry out signal control processes corresponding to the signal amplification and the effect impartment in addition to tone signal generation is prepared. For example, as shown in "Owner's Manual of GW50 GUITAR PERFORMANCE EFFECTOR", 1993, issued by YAMAHA Corporation, searched in the Internet (see http://www2.yamaha.co.jp/manual/pdf/emi/english/synth/GW50E.PDF), a user operates a predetermined set-up operator while looking a screen and the like prepared in advance, whereby settings of parameters can be carried out. Moreover, Japanese Patent Application Laid-open Publication No. 08-076752 discloses technique (so-called autoload function) to automatically load tone information stored in an external storage medium on an internal memory of a tone signal generation device without carrying out complicated operation.

Now, the user is allowed for so-called "sound production (or tone generation)" by setting up various parameters for determining the respective characteristics to each of the element blocks that carry out the signal control processes according to the tone signal generation, the signal amplification and the effect impartment described above. Therefore, it is thought that the user stores parameters set up in advance by other device in a USB memory or the like, the USB memory is attached (or inserted) to the tone signal generation device, and set-up parameters are autoloaded in an internal memory in the device. The setting of the parameters by autoloading is a convenient function, but the parameters of the internal memory are overwritten without the user's intention even though they have already been loaded. Thus, in the case where the user edited the parameters after loading, it is inconvenient because the edit content is to be lost. Namely, when a USB memory is attached again to the device after the parameter read from the USB memory has been edited, the edited parameter (data after edit) is to be overwritten into the parameter (data before editing) of the USB memory. For this reason, the edited parameter cannot be written into the USB memory.

Further, even though a parameter is copied between a plurality of USB memories, a parameter stored in a USB memory as a copy source is to be overwritten onto a parameter stored in a USB memory as a copy destination if the USB memory as the copy destination is attached to the device after the parameter is read from the USB memory as the copy source. Therefore, it cannot be copied. Moreover, in the case where the installed USB memory becomes a release state despite user's intention, it is inconvenient because the edit content is lost whenever the USB memory is reinstalled correctly.

SUMMARY OF THE INVENTION

This invention is made in consideration of the circumstances described above, and it is an object of the present invention to provide a tone signal creating apparatus capable of preventing the edit content from being lost without conditions by autoload in response to attachment of a transportable storage media (USB memory or the like) in which data (file) as a subject of autoload are stored in the case of having an autoload function.

In one aspect of the present invention, the present invention is directed to a tone signal creating apparatus comprising a plurality of element blocks each handling any of signal control processes including at least tone signal generation, signal amplification and effect impartment to accomplish a sequence of the signal control processes based on a combination of the signal control processes handled by the respective element blocks, the tone signal creating apparatus being capable of creating various tone signals in accordance with the combination of the signal control processes of the respective element blocks, the tone signal creating apparatus further comprising: a storage section for storing plural kinds of detailed parameters for each of the plurality of element blocks; an attachment section for detachably attaching a transportable storage device; a detecting section for detecting whether a transportable storage device is attached to the attachment section or not; and an updating section that reads, when the detecting section detects that the transportable storage device is attached to the attachment section, an automatic reading file composed of plural kinds of detailed parameters having stored in the detected transportable storage device, and collectively updates the plural kinds of detailed parameters stored in the storage section by the read automatic reading file, said updating section determining, in accordance with a user's instruction, whether the collectively updating based on a currently-read automatic reading file should be carried out or not in the case where an automatic reading file has already been read by the updating section, wherein the plurality of element blocks carry out any signal control process of the at least tone signal generation, signal amplification and effect impartment on the basis of the plural kinds of detailed parameters for each of the element blocks stored in the storage section.

According to the present invention, the tone signal creating apparatus is controlled so that it is determined whether update, to the currently-read automatic reading file, of the automatic reading file stored in the storage section is carried out or not in accordance with the user's instruction and the process is carried out in accordance with the automatic reading file composed of the plural kinds of detailed parameters stored in the transportable storage device detected by the detection section, in the case where the plural kinds of detailed parameters stored in the storage section are collectively updated when the automatic reading file has already been read by the update section. Namely, in the case where the automatic reading file has not been read yet, the automatic reading file stored in the storage section is updated without any condition. On the other hand, in the case where the automatic reading file has already been read, the automatic reading file stored in the storage section may be edited on the basis of it. Thus, inquiry about update to the user is made, and it is controlled whether or not parameter update is carried out by reading of the automatic reading file in accordance with its response (user's instruction). Therefore, without deteriorating convenience of automatic reading, the edited automatic reading file is never restored to a state before editing by means of overwriting despite user's intention. Namely, it is possible to prevent the content edited by the user from being unexpectedly overwritten and restored to an original state.

As a preferred embodiment of the present invention, it is preferable that the tone signal creating apparatus further includes: a generating section that generates an automatic reading file composed of default detailed parameters prepared in advance, and stores the generated automatic reading file in the transportable storage device in the case where the automatic reading file is not stored in the transportable storage device whose attachment to the attachment section is detected by the detecting section; and a writing section that writes all or a part of the plural kinds of detailed parameters for each of the element blocks stored in the storage section into the automatic reading file stored in the transportable storage device. This allows the user to write the edited content without modification in a transportable storage device newly installed after automatic reading. Namely, it is possible to copy data between different transportable storage devices easily.

According to the present invention, an effect is achieved that it is possible to prevent the edit content from being lost without conditions by autoload because user confirmation is prompted by means of inquiry to the user in response to attachment of a transportable storage media that is a subject of an autoload function. Further, the user can carry out data copy between different transportable storage devices easily.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF DRAWINGS

The foregoing and other objects, features and advantages of the present invention will become more readily apparent from the following detailed description of a preferred embodiment of the present invention that proceeds with reference to the appending drawings, in which:

FIG. 13B is a second conceptual diagram for explaining concrete operational procedures and display content of the indicator at that time when a parameter is assigned to a control knob;

DETAILED DESCRIPTION OF THE INVENTION

Hereinafter, an embodiment of the present invention will be described in detail with reference to the appending drawings.

Figure 1:
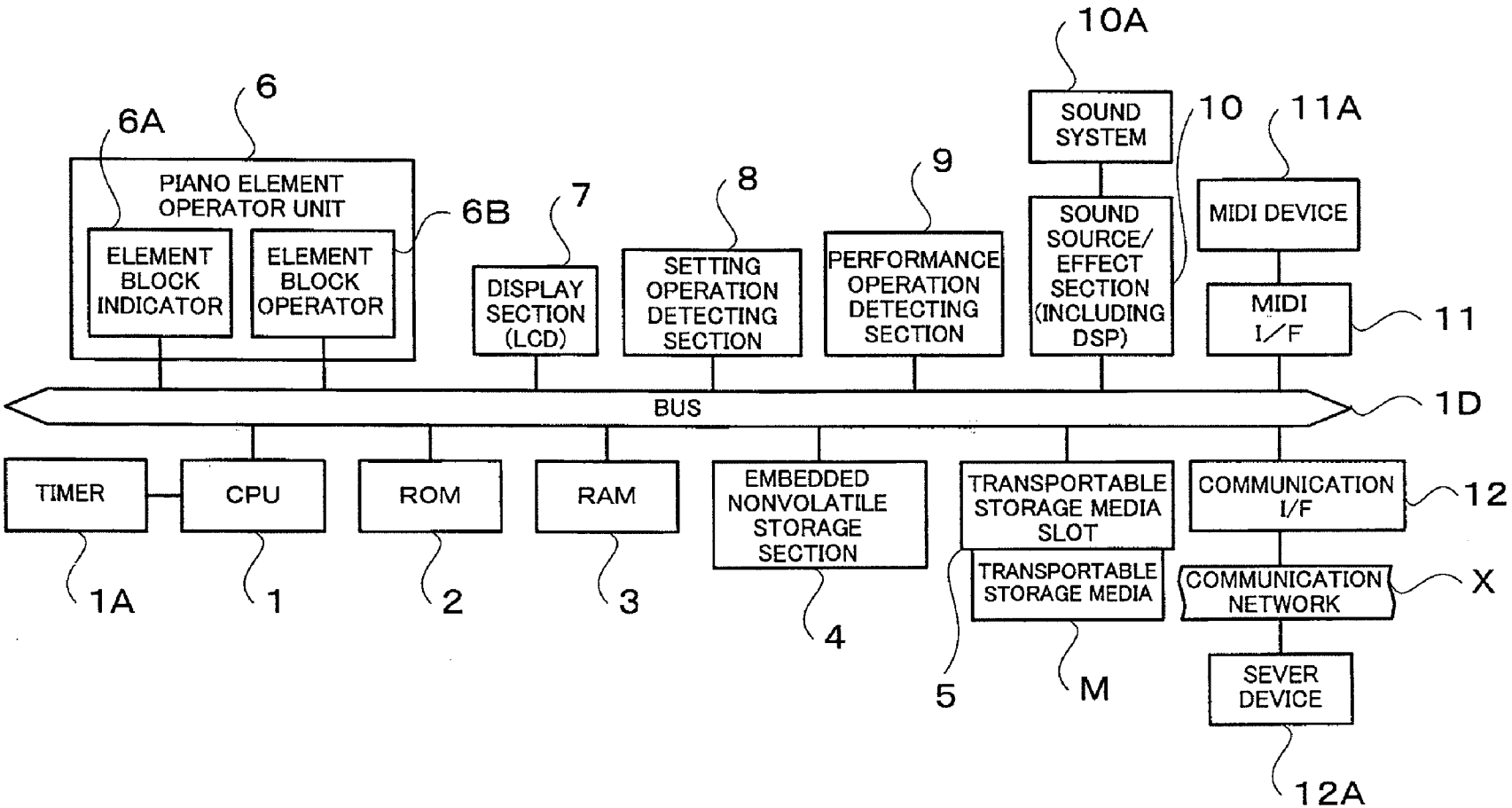
FIG. 1 is a block diagram of a hard configuration showing one embodiment of a whole configuration of an electronic musical instrument to which a tone signal creating apparatus according to the present invention is applied.

FIG. 1 is a block diagram of a hard configuration showing one embodiment of a whole configuration of an electronic musical instrument to which a tone signal creating apparatus according to the present invention is applied. An electronic musical instrument illustrated in the present embodiment is controlled by a micro computer composed of a micro processor unit (CPU) 1, a read only memory (ROM) 2 and a random access memory (RAM) 3. The CPU 1 is adapted to control an operation of the whole electronic musical instrument. Each of the ROM 2, the RAM 3, an embedded nonvolatile storage section 4, a transportable storage media slot 5, a piano element operator unit 6, a display section 7, a setting operation detecting section 8, a performance operation detecting section 9, a sound source/effect section 10, a MIDI interface (I/F) 11 and a communications interface (I/F) 12 is connected to this CPU 1 via a data and address bus 1D. Moreover, a timer 1A for measuring interrupting time in a timer interrupting process (interrupt process) and various kinds of time is also connected to the CPU 1. For example, the timer 1A generates a clock pulse, and supplies the generated clock pulse to the CPU 1 as a process timing command, or to the CPU 1 as an interrupting command. The CPU 1 carries out various processes in accordance with these commands.

Figure 2:
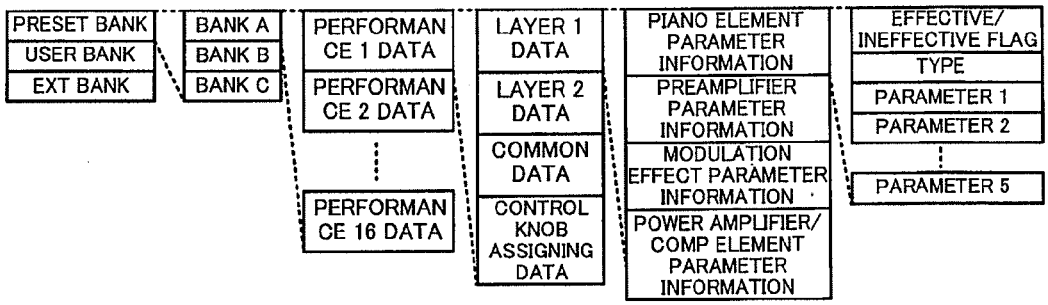
FIG. 2 is a conceptual diagram showing one embodiment of a data configuration of a performance memory.

The ROM 2 stores various control programs carried out or referenced by the CPU 1, and various kinds of data such as "preset bank" shown in FIG. 2 (will be described later) provided or set up by a maker (or manufacturer) in advance, for example. The RAM 3 is used as a working memory for temporarily storing various kinds of data generated when the CPU 1 carries out a predetermined program and the like, or as a memory for temporarily storing programs that are currently carried out and data related to the programs. Predetermined address areas of the RAM 3 are respectively assigned to these functions to be used as a register or a flag, a table, a temporary memory and the like. In this regard, in this embodiment, when tone signals are generated or controlled, the CPU 1 does not refer to each of the bank data stored in the ROM 2, the embedded nonvolatile storage section 4 or a transportable storage media M attached (inserted) to the transportable storage media slot 5 directly, but refers to each of the bank data read out therefrom and stored in a performance memory held in the RAM 3 (see FIG. 2, which will be described later).

The embedded nonvolatile storage section 4 is a hard disk device embedded in the electronic musical instrument in advance, for example. The embedded nonvolatile storage section 4 stores various control programs such as a simulation program (not shown in the drawings) for signal control carried out by the CPU 1, for example, in addition to various kinds of data such as "user banks" (will be described later) shown in FIG. 2 that are arbitrarily created by individual users. In this regard, in the case where control programs are not stored in the ROM 2 described above, the control programs may be caused to be stored in this embedded nonvolatile storage section 4, and be read out onto the RAM 3. This makes it possible to cause the CPU 1 to carry out the similar operation when the control programs are stored in the ROM 2. By constructing the electronic musical instrument in this manner, addition or version upgrade of control programs can be carried out easily. In this regard, the embedded nonvolatile storage section 4 is not limited to the hard disk device (HD), but may be a storage device using various forms of storage media. Alternatively, the embedded nonvolatile storage section 4 may be a semiconductor memory such as a flash memory.

The transportable storage media slot 5 has one or more connecting terminal (for example, USB (Universal Serial Bus) terminal). The transportable storage media slot 5 is an interface control device for carrying out control to transmit and receive various kinds of information between the electronic musical instrument and the transportable storage media M (for example, USB memory) connected to the USB terminal. In this embodiment, when a transportable storage media M is inserted into the transportable storage media slot 5, the transportable storage media slot 5 confirms whether a specific automatic read file (here, an "EXTERNAL (EXT) bank" (will be described later) shown in FIG. 2, which is arbitrarily created by an external device) is stored in the transportable storage media M or not by referring to it. In the case where the automatic read file is stored, the tone signal creating apparatus has a function to automatically writing the file in the RAM 3 (so-called autoload function). The tone signal creating apparatus normally refers to under a ROOT directory in the transportable storage media M.

In the present embodiment, the tone signal creating apparatus is adapted to generate and control tone signals by setting up a plurality of parameters contained in one performance datum to the RAM 3 or a register of the sound source/effect section 10. The one performance datum is selected from original bank data such as a "preset bank" stored in the above ROM 2, a "user bank" stored in the embedded nonvolatile storage section 4, and an "EXT bank" stored in the transportable storage media M and autoloaded on the RAM 3 when the transportable storage media M is inserted into the transportable storage media slot 5. A user can appropriately changes settings of the RAM 3 or the register of the sound source/effect section 10, whereby generation and control of tone signals can be changed. Further, the settings of the RAM 3 or a plurality of registers of the sound source/effect section 10 can be stored as one performance datum in the "user bank" stored in the embedded nonvolatile storage section 4 or the "EXT bank" stored in the transportable storage media M. Further, they can be saved in the "user bank" stored in the embedded nonvolatile storage section 4 or the "EXT bank" stored in the transportable storage media M in a lump for each of the bank data. However, they cannot store or save in the "preset bank" stored in the ROM 2 or the "EXT bank" at a state where no transportable storage media M is inserted in the transportable storage media slot 5.

Here, a data configuration of each of the bank data respectively stored in the ROM 2, the embedded nonvolatile storage section 4 and the transportable storage media M described above or loaded in the RAM 3 will be described using FIG. 2. FIG. 2 is a conceptual diagram showing one embodiment of the data configuration of the performance memory. However, since the data configuration of the bank data in each of the preset bank, the user bank and the EXT bank is the same as each other, only the preset bank data will be described herein.

The preset bank data contain a plurality of individual data sets each of which defines different combination of a large number of tone signal creating parameters (here, three pieces of BANKs A, B, C as one example). The individual data set has a plurality of performance data (here, 16 pieces of data for performances 1 to 16 as one example) as combination of different tone signal creating parameters. Each of these performance data is supplied as one parameter set when to create tone signals, and the tone signals created on the basis of a large number of parameters included in the performance data are characterized. Therefore, the user is required to select, at the beginning, to use any of the performance data before starting to create the tone signals (see FIG. 3, which will be described later).

The performance data characterizing the tone signals are composed of layer data, common data and control knob assigning data. The layer data are data defining parameter information of each of a plurality of element blocks for controlling a signal processing section (element block, which is not shown in the drawings) that carries out signal control (simulation and the like) corresponding to each characteristic for each of a sequence of process series (here, as one example, two series of Layer 1 and Layer 2, of course, but it is not limited to the two series). The sequence of process series is composed of a plurality of process steps (signal control processes) to create tone signals by means of simulation by combining a plurality of element blocks, such as a tone signal generation characteristic, a tone signal amplifying characteristic and an effect impartment characteristic to the tone signal.

As the parameter information for the plurality of element blocks defined in each of the layer data, there are piano element parameter information, preamplifier parameter information, modulation effects parameter information, and power amplifier/comp element parameter information corresponding to the element blocks. Each kind of the parameter information includes, in addition to a process type (name) in the element block, an effective/ineffective parameter for determining whether signal control is carried out at the element block or not, and various detailed parameters for controlling the element block (up to five parameters; parameters 1 to 5). As one example, the piano element parameter information contains, for example, various parameters necessary to generate a tone waveform by controlling a PCM waveform such as decay time (DecayT), release time (ReleaTim), key off (Keyof), start point (StrP) and hammer (HammerTe) or various parameters characterizing the tone waveform generated by simulation.

In the electronic musical instrument according to the present embodiment, algorism for realizing a signal control process corresponding to each of the element blocks is defined uniquely for each of the types. When the above process type is switched, the algorism for realizing the process of a DSP is switched (in tone signal generation characteristics, switching of a PCM waveform read out from the waveform memory is also included), and a parameter kind for controlling it is also switched. As the algorism, for example, algorism of a simulation program for realizing, by simulation, a signal control process similar to an analog effector circuit or an amplifier circuit by combining a large number of electric elements as conventionally known is mentioned.

The common data contain parameter information for adjusting a characteristic of an element block that subjects the tone signal generated by the two process series (layers) described above to a common signal control process, and parameter information for subjecting all of the element blocks to the common signal control process. As one example of such parameter information for adjusting the characteristic of the common element block, there are parameter information regarding a "reverb process" including a plurality of detailed parameters for determining a kind of reverb effects such as a hall and a room, parameter information regarding a "multi equalizer (MEQ) process" including a plurality of detailed parameters for determining a frequency characteristic suitable for any of five kinds of musical genre including flat/jazz/pops/rock/classic (concert), and the like.

The control knob assigning data are composed of a plurality of detailed parameters arbitrarily combined in a large number of detailed parameters included in each piece of parameter information on one performance data (as will be described later, it is possible to specify up to six pieces in the present embodiment). This combination is not limited to one in which detailed parameters regarding the same element block are combined, and may be one in which detailed parameters regarding a different element block are combined. As will be described later, the user is allowed to arbitrarily specify its combination (see FIG. 12 and FIG. 13, which will be described later).

Returning to FIG. 1, the piano element operator unit 6 detects an operation of each of a plurality of element block operating sections 6B (piano element switches) provided on a panel of a body of the electronic musical instrument in advance, and outputs switching information and the like according to the operation state to the CPU 1 via the data and address bus 1D. Further, an element block indicator 6A composed of a light-emitting element such as an LED is arranged in the vicinity of each of the element block operating sections 6B. Controlling of turn on/turn off/blink of each of these element block indicators 6A can also be carried out. Detailed explanation of the piano element operator unit 6 including these element block indicator 6A and element block operating section 6B will be described later (see FIG. 4).

The display section 7 is a display constructed from a liquid crystal display panel (LCD), a CRT or the like, for example, arranged on the panel. The display section 7 presents the plurality of parameters 1 to 5 (detailed parameters in each element block) defined for each parameter information of FIG. 2 and a plurality of detailed parameters defined in the control knob assigning data, or displays a control state of the CPU 1 and the like. However, the display section 7 used herein is, for example, a display device having a relatively low resolution/display capability, which can display only information composed of dozens of characters in each of upper and lower lines at once. Detailed explanation of the display content in this display section 7 will be described later (see FIG. 5 and FIG. 13).

The setting operation detecting section 8 detects an operation of set-up operators assigned as operators other than the element block operating section 6B described above, for example, turn-operable and pressing-operable control knobs, provided in the vicinity of the above display section 7, constituting a parameter operator unit (see FIG. 5, which will be described later), a switch, constituting other operator unit (see FIG. 3, which will be described later), for selecting any bank data of preset bank, user bank and EXT bank, a switch for selecting individual data set (BANKs A, B, C) contained in the bank data, a switch for selecting performance data (performances 1 to 16) contained in the individual data set, and the like. The setting operation detecting section 8 outputs switching information in accordance with its operation state and the like to the CPU 1 via the data and address bus 1D. Of course, in addition to one described above, the setting operation detecting section 8 may include various operators such as a numerical keypad for inputting numerical data to select, set up or control pitch, tone (color), effect and the like, and a keyboard for inputting character data.

The performance operation detecting section 9 detects pressing and releasing of a performance operator (not shown in the drawings), such as a keyboard, for example, provided with a plurality of keys for selecting pitch of the generated tone signal, and generates a detection output. When the performance operator is operated by the user, an instruction to generate a tone signal is made against the sound source/effect section 10. Of course, it is not limited to generation of the tone signal in response to an operation of the performance operator by the user himself or herself. For example, it may be adapted so that the tone signal can be generated on the basis of MIDI data or the like acquired from an external MIDI device 11A such as a sequencer via the MIDI interface 11.

The sound source/effect section 10 can generate a plurality of tone signals at the same time. Performance information supplied via the data and address bus 1D is inputted into the sound source/effect section 10 in accordance with a key pressing operation of the performance operator and the like, and the tone signal is generated in accordance with a tone generation characteristic based on this performance information. The tone signal generated in the sound source/effect section 10 is subjected to signal control according to a signal amplifying characteristic or an effect impartment characteristic, and tone (or sound) is produced from a sound system 10A including an amplifier and a speaker. For such a configuration of the sound source/effect section 10 and the sound system 10A, any conventional configuration may be used. For example, the sound source/effect section 10 may adopt any of various music synthesis systems such as a FM, a PCM, a physical model and a formant synthesis, may be configured by dedicated hardware including a waveform memory, or may be configured by a software process (simulation program and the like) by the DSP.

In this regard, as described above, in the electronic musical instrument according to the present embodiment, algorism of a simulation process is defined depending upon a process type, and the electronic musical instrument can be adapted to switch between algorism carried out by a DSP, which achieves generation of tone signals, and tone signals (PCM waveform and the like) read out from the waveform memory by switching process types. Namely, the sound source/effect section 10 can generate tone signals by means of the plurality of music synthesis systems. By switching them as needed, the sound source/effect section 10 can generate a plurality (two series) of tone signals at the same time in accordance with one music synthesis system, or can generate a plurality (two series) of tone signals at the same time in accordance with different music synthesis systems.

The MIDI interface (I/F) 11 is an interface for inputting MIDI forms of performance information (so-called MIDI data) from an external MIDI device 11A or the like to the electronic musical instrument, or for outputting MIDI forms of performance information from the electronic musical instrument to the MIDI device 11A. The MIDI device 11A may be any device so long as it is a device that generates MIDI forms of performance information.

The communications interface (I/F) 12 is an interface for transmitting and receiving control programs, various kinds of data and the like between the electronic musical instrument and an external server device 12A via a communication network X. For example, this makes it possible to acquire a user bank newly created and registered in the server device 12A by other user via the communication network X. This communications interface 12 may be a LAN, the Internet, phone lines and the like, for example, and is not configured by either wired or wireless but by both wired and wireless.

Figure 3:
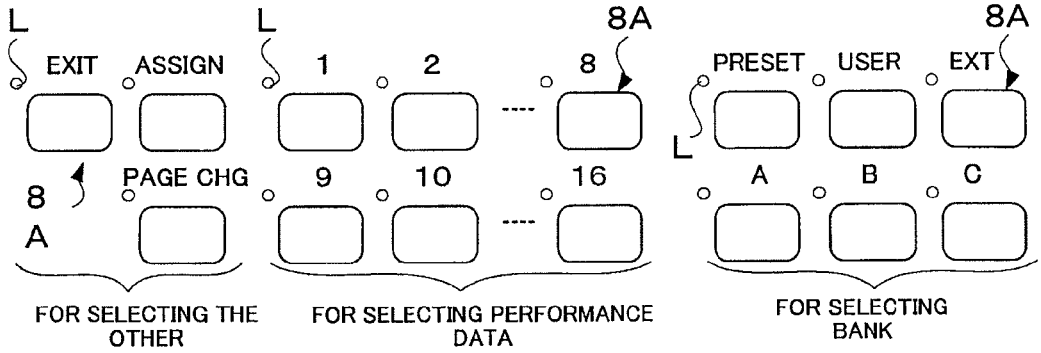
FIG. 3 is a conceptual diagram showing a concrete configuration example of other operator unit.

Next, concrete configuration examples of other operator unit, the piano element operator unit and the parameter operator unit provided on the panel of a body of this electronic musical instrument and an operation mode thereof will be described using FIG. 3 to FIG. 5. FIG. 3 is a conceptual diagram showing a concrete configuration example of other operator unit.

As shown in FIG. 3, configurations of the other operator unit can largely be divided into a "first group of operators for selecting banks" for determining a bank kind composed of six pieces of set-up operators 8A (switch) shown at the right of FIG. 3, a "second group of operators for selecting performance data" for determining performance data composed of 16 pieces of set-up operators 8A shown at the center of FIG. 3, and a "third group of operators for selecting the other" for realizing a predetermined function other than the above composed of three pieces of set-up operators 8A shown at the left of FIG. 3. A printing display showing functions assigned so that the user can visibly recognize a function assigned to each of the operators 8A on the panel is printed in the vicinity of each operator 8A included in each of the groups of operators. Further, LEDs (L) to be turned on and off in response to a pressing operation are provided so that the user can grasp the operators 8A each of which becomes an on state on the panel.

Of the plurality of set-up operators 8A included in the "first group of operators for selecting banks", the three operators 8A arranged at the upper line side are operators to which functions for respectively selecting preset bank, user bank and EXT bank of the performance memory are assigned in advance in order from the left. On the other hand, the three operators 8A arranged at the lower line side are operators to which functions for respectively selecting a plurality of individual data sets (BANK A to C) included in any of the preset bank, the user bank and the EXT bank selected in response to an operation of each operator at the upper line side are assigned in advance in order from the left. For example, in the case where the user presses "B" of the center of the lower line side and the operator 8A printed and displayed after pressing "PRESET" at an upper left end and the operator 8A printed and displayed, individual data sets of a "BANK B" in the "preset bank" stored in the performance memory of the RAM 3 are specified.

A plurality of performance data 1 to 16 contained in an individual data set (any of BANKs A to C) specified as described above are associated with the plurality of set-up operators 8A included in the "second group of operators for selecting performance data". For that reason, for example, in the case where the user presses "10" included in the second group of operators and the operator 8A printed and displayed, "performance data 10" of the "BANK B" in the "preset bank" are specified. Thus, the operator 8A included in the second group of operators becomes an operator for selecting the performance data 1 to 16 determined in response to an operation of the first group of operators.

The plurality of set-up operators 8A included in the "third group of operators for selecting the other" are dedicated operators to which functions such as "ASSIGN", "PAGE CHG" and "EXIT" are assigned in advance, for example. In the present embodiment, an "ASSIGN" switch is one for starting to carry out parameter assignment (will be described later), a "PAGE CHG" switch is one for switching display into a screen in which a parameter name and a current parameter value are displayed assigned to each control knob in order to clear the parameter assignment, and an "EXIT" switch is one for clearing a parameter assigning state to the control knob. Details thereof will be described later (see FIG. 13).

Figure 4:
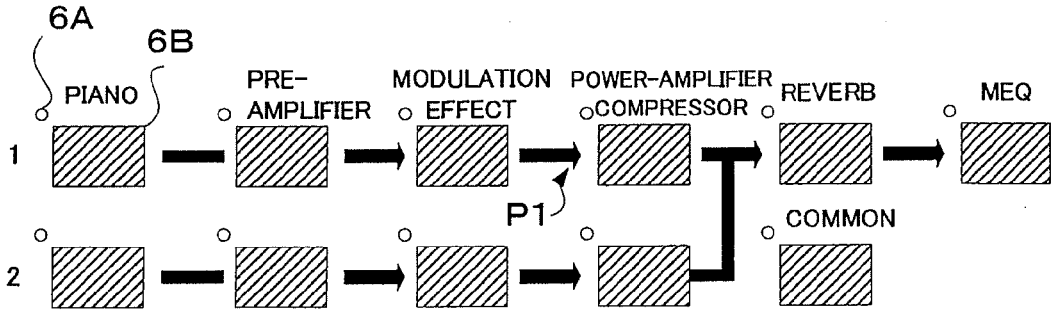
FIG. 4 is a conceptual diagram showing a concrete configuration example of a piano element operator unit.

FIG. 4 is a conceptual diagram showing a concrete configuration example of the piano element operator unit. As shown in FIG. 4, the piano element operator unit is constructed by a plurality of element block operating sections 6B (switch), and element block indicators 6A made of light-emitting elements such as LED, for example. Each of the element block indicators 6A is arranged in the vicinity of the corresponding element block operating section 6B. Layer 1 data, Layer 2 data and common data contained in the performance data specified in response to an operation of the "second group of operators for selecting performance data" described above are associated with the element block operating sections 6B, respectively.

The parameter information of the respective element blocks contained in Layer 1 data is associated with each of the four operators 6B from the left arranged in the upper line of FIG. 4. The parameter information of the respective element blocks contained in Layer 2 data is associated with each of the four operators 6B from the left arranged in the lower line of FIG. 4. In the vicinity of each of the operators 6B included in the piano element operator unit, a printing display indicating an assigned function is printed in advance so that the user can immediately confirm a function (element block) assigned to each of the operators 6B on the panel. This printing display is printed in order of a sequence of process steps, and the parameter information of each of the element blocks corresponding to the printing display is associated with each of the operators 6B.

Namely, in the embodiment illustrated herein, in order from the left, the "piano element parameter information" is associated with the operating section 6B on which "PIANO" is printed and displayed, the "preamplifier parameter information" is associated with the operating section 6B on which "PRE-AMPLIFIER" is printed and displayed, the "modulation effects parameter information" is associated with the operating section 6B on which "MODULATION EFFECT" is printed and displayed, and the "power amplifier/comp element parameter information" is associated with the operating section 6B on which "POWER-AMPLIFIER COMPRESSOR" is printed and displayed. Further, parameter information regarding the "reverb process" and the "multi equalizer (MEQ) process" of the common data are respectively associated with the operating section 6B on which "REVERB" is printed and displayed and the operating section 6B on which "MEQ" is printed and displayed other than the above ones. Further, parameter information for subjecting all of the element blocks to common control is associated with the operating section 6B on which "COMMON" is printed and displayed.

When an arbitrary operating section 6B in the piano element operator unit associated with the parameter information of each of the element blocks is operated in a predetermined operation mode as described above, effective/ineffective of the element block associated with the operating section 6B is switched. For example, in the case where the user shortly presses the operating section 6B at the upper left end on which the "PIANO" is printed and displayed, the element block for generating a tone signal is switched into effective and the tone signal is generated. On the other hand, in the case where the user shortly presses the operating section 6B at an effective state again, the element block for generating the tone signal is switched into ineffective and no tone signal is generated. Further, in the case where the user shortly presses the other operating section 6B, for example, any of the operators 6B on each of which "PRE-AMPLIFIER", "MODULATION EFFECT", or "POWER-AMPLIFIER COMPRESSOR" is printed and displayed, the element block (simulation process or the like) corresponding to each element block is switched into effective and the tone signal is subjected to a signal control process such as modulation. On the other hand, in the case where the user shortly presses the operating section 6B at an effective state again, each of the element blocks is switched into ineffective, the tone signal is not subjected to the signal control process, and the tone signal passes through next process steps. In this regard, when the element block is set to effective, the element block indicator 6A (LED) arranged in the vicinity of the operated operating section 6B is turned on. When the element block is set to ineffective, the element block indicator 6A is turned off.

Figure 5:
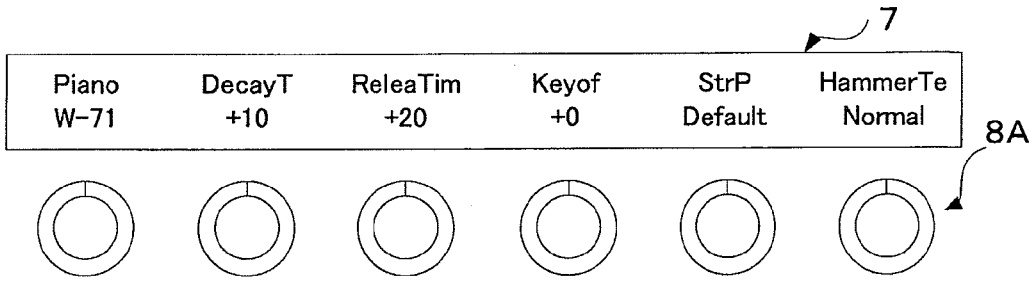
FIG. 5 is a conceptual diagram showing a concrete configuration example of a parameter operator unit.

Further, in the case where the user presses and holds down an arbitrary operating section 6B of the piano element operator unit associated with the parameter information of each of the element blocks for a predetermined period of time or more different from the operation mode (shortly pressing) as described above, the detailed content of the parameter information associated with the operated operating section 6B is displayed on the parameter operator unit shown in FIG. 5. For example, in the case where the user presses and holds down the operating section 6B at the upper left end on which the "PIANO" is printed and displayed, the type constituting the piano element parameter information and the plurality of parameters 1 to 5 are displayed in the parameter operator unit.

Here, the parameter operator unit described above will be described using FIG. 5. FIG. 5 is a conceptual diagram showing a concrete configuration example of the parameter operator unit. The parameter operator unit is configured from the display section 7 composed of a display device such as an LCD and the plurality of control knobs (set-up operators) 8A. In the display section 7, a detailed parameter of the parameter information associated with an arbitrary operating section 6B in the operated piano element operator unit pressed and held down for the predetermined period of time or more is displayed so as to be associated with the control knob 8A (display screen at the edit mode). Here, the detailed parameter display in the case where the operating section 6B of the "PIANO" display is operated is shown as an example.

More specifically, with respect to the type of the piano element parameter information and the parameters 1 to 5, the parameter name and the parameter value thereof are respectively displayed in the upper and lower lines of the display section 7 in order from the left. In the example shown in the drawing, a process type "W-71", a parameter value "10" of the "DecayT (decay time)" parameter, a parameter value "+20" of the "ReleaTim (release time)" parameter, a parameter value "0" of the "Keyof (key off)" parameter, a parameter value "Default" of the "StrP (start point)" parameter and a parameter value "Normal" of the "HammerTe (hammer)" parameter can be understood with respect to the piano element parameter information. In the case of being in this display state, the user can arbitrarily set up each detailed parameter by operating the plurality of control knobs 8A arranged under the display section 7 so as to correspond to display of each parameter.

As described above, by pushing an arbitrary operating section 6B in the piano element operator unit once, setting of effective/ineffective of the element block can be reversed, and by pressing and holding down the operating section 6B, the detailed parameter related to the element block is shifted to the edit mode for editing. Namely, the setting of effective/ineffective of each of the element blocks and the change into parameter editing of each of the element blocks can be separated and carried out in accordance with an operation mode of the same operating section 6B. When to shift to this edit mode, a blinking mode of an LED is changed so that the user can understand whether the element block is in an effective state (normal LED turn-on state) or in an ineffective state (normal LED turn-off state). More specifically, blinking intervals are changed. For example, the blinking intervals may be controlled so that blinking at long time intervals indicates the case where the element block at the effective state shifts to the edit mode and blinking at short time intervals indicates the case where the element block at the ineffective state shifts to the edit mode. Namely, in the case where the element block is in the effective state and is not selected as the edit subject, the LED is always turned on. In the case where the element block is in the ineffective state and is not selected as the edit subject, the LED is turned off. However, in the case where the element block is in the effective state and is selected as the edit subject, the LED blinks at long time intervals. In the case where the element block is in the ineffective state and is selected as the edit subject, the LED blinks at short time intervals.

In this regard, the number of parameters constituting the parameter information may be less than five depending upon the kind (process type) of element block. In that case, display corresponding to a part of the control knobs 8A in the display section 7 becomes a blank.

In this regard, the process type may not be able to be changed depending upon the kind of element block. For example, since the process type of preamplifier is uniquely determined by the process type of piano element, the process type cannot be changed in such a case (in display in the display section 7, display corresponding to the control knob 8A to which the process type is assigned becomes a blank).

Further, in the present embodiment, the parameter information of each of the element blocks associated with the operating section 6B thus pressed and held down of the piano element operator unit is displayed in the display section 7 of the parameter operator unit, whereby the user can set up their detailed parameters while looking at the display section 7. In addition, the user can display a plurality of detailed parameters of different element blocks arbitrarily combined at the same time. Therefore, the user is allowed to carry out the settings thereof even during the performance by instantaneously reading out the detailed parameters of the different element blocks. Detailed explanation about the parameter assignment to do that will be described later (see FIG. 13 and the like).

As described above, the electronic musical instrument according to the present invention is constructed by combining a plurality of element blocks respectively handling a sequence of signal control processes in a stepwise manner. The electronic musical instrument creates a wide variety of tone signals by the signal control processes for every element block. The user is allowed to select any of a plurality of different process types for achieving the signal control process in accordance with respective characteristics in each of the element blocks. The user is also allowed to create a desired tone signal by appropriately changing a detailed parameter in order to adjust the control content by the selected process type (or determine the characteristic of the element block).

Figure 6:
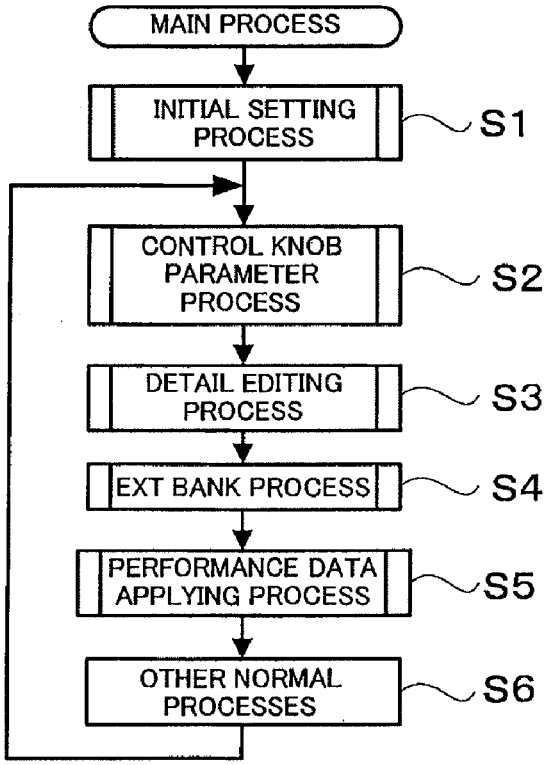
FIG. 6 is a flowchart showing one embodiment of a main process.

Therefore, creation of tone signals in the electronic musical instrument shown in FIG. 1 will be described using FIG. 6. FIG. 6 is a flowchart showing one embodiment of a "main process" for creating tone signals by the signal control process for each of the plurality of element blocks, which realizes a sequence of process steps.

At Step S1, an "initial setting process" is carried out (see FIG. 7, which will be described later). At Step S2, a "control knob parameter process" is carried out (see FIG. 11, which will be described later). At Step S3, a "detail editing process" is carried out (see FIG. 14, which will be described later). At Step S4, an "EXT bank process" is carried out (see FIG. 15, which will be described later). At Step S5, a "performance data applying process" is carried out (see FIG. 16, which will be described later). At Step S6, other normal processes are carried out. The other normal processes include a process for switching between the edit mode and the performance mode and a process for overwriting the user bank data or EXT bank data in the performance memory onto the original addresses from which they have been read out, for example. The processes at Step S2 to Step S6 described above are repeatedly carried out until power of the electronic musical instrument is turned off.

Figure 7:
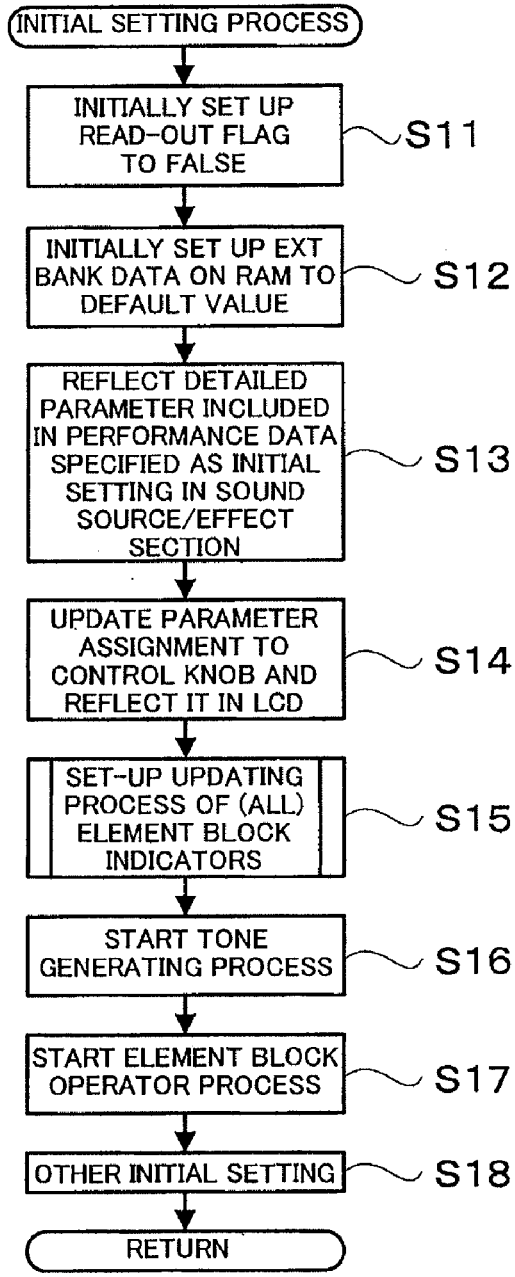
FIG. 7 is a flowchart showing one embodiment of an initial setting process.

FIG. 7 is a flowchart showing one embodiment of the "initial setting process" (see Step S1 of FIG. 6). At Step S11, a read-out flag used for determining whether an automatic reading file is autoloaded from the transportable storage media M attached (inserted) to the transportable storage media slot 5 or not is initially set up to "FALSE (that is, it has not been read)".

At Step S12, a performance memory, which corresponds to the performance data of the EXT bank, on the RAM 3 is initially set up to a default value prepared in advance. Namely, even though any transportable storage media M is inserted to the transportable storage media slot 5, performance data contained in the "EXT bank" can be selected to be applied to generation and control of tone signals.

At Step S13, parameter information for each of a plurality of element blocks of performance data specified as an initial state in advance is assigned to the element block operating section 6B (piano element switch) of the piano element operator unit 6 (see FIG. 4), and all of the detailed parameters are reflected to the sound source/effect section 10. The performance data specified as the initial state in advance are a preset bank, BANK A and performance data 1, for example. At Step S14, the parameter assignment to the control knob 8A of the parameter operator unit is updated by plural kinds of parameter information contained in the specified performance data, and display regarding the detailed parameter is reflected to the display section 7 (LCD) (see FIG. 5: the display screen of the edit mode). At Step S15, all of the element blocks are set up to effective or ineffective in accordance with the performance data that have been specified as an initial state in advance, and a "set-up updating process for an element block indicator" (see FIG. 10, which will be described later) is carried out so as to reflect them in all of the element block indicators 6A (LEDs of the piano element operator unit). At Step S16, it is instructed to start a "tone generating process" prepared separately as parallel processing (see FIG. 8, which will be described later). At Step S17, it is instructed to start an "element block operator process" prepared separately as parallel processing (see FIG. 9, which will be described later). At Step S18, other initial setting than the above is carried out.

Figure 8:
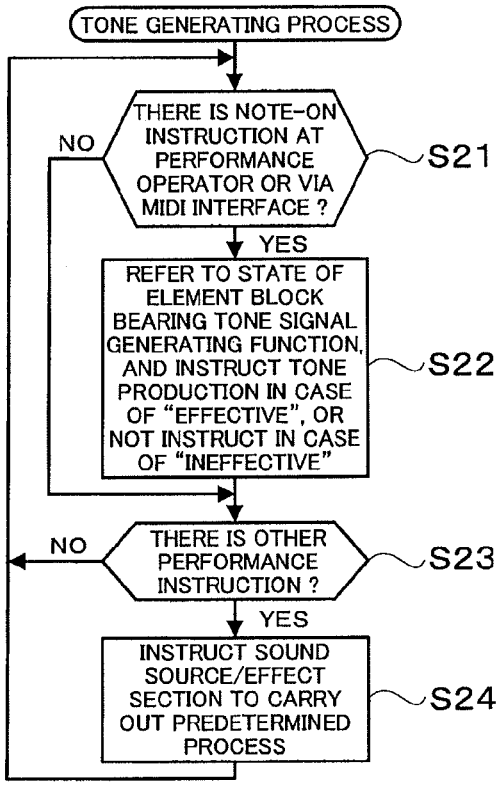
FIG. 8 is a flowchart showing one embodiment of a tone generating process.

FIG. 8 is a flowchart showing one embodiment of the "tone generating process" (see Step S16 of FIG. 3). At Step S21, it is determined whether there is a note-on instruction via a performance operator (not shown in the drawings) or the MIDI interface 11 or not. In the case where it is determined that the note-on instruction is received ("YES" at Step S21), the CPU 1 refers to a setting state for the element block bearing a first tone signal generating function in a sequence of processes. In the case where the element block is set to "effective", the CPU 1 instructs a signal processing section (not shown in the drawings) as a tone production instructing subject to produce tones. On the other hand, in the case where it is set to "ineffective", the CPU 1 does not instruct the signal processing section as the tone production instructing subject to produce tones (Step S22). In the case where the signal processing section is instructed to carry out tone production, tone signals are generated. In the case where the signal processing section is not instructed to carry out the tone production, no tone signal is generated. Therefore, needless to say, in the case where both two series are set up to "ineffective", the user can merely confirm parameter values in accordance with the display content of the display section 7 even though a change in the detailed parameters or the like is carried out for the element blocks bearing the respective following functions in a sequence of processes. In this regard, the signal processing section of the tone production instructing subject (signal control process) is determined in accordance with the process type thus specified.

At Step S23, it is determined whether there is a performance instruction other than the note-on instruction or not. In the case where it is determined that there is a performance instruction other than the note-on instruction ("YES" at Step S23), the CPU 1 instructs the sound source/effect section 10 to carry out a predetermined process corresponding to other performance instruction (Step S24). In the case where it is determined that there is no performance instruction other than the note-on instruction ("NO" at Step S23), or after the process at Step S24 is terminated, the CPU 1 returns to the process at Step S21, and the processes at Steps S21 to S24 described above are repeatedly carried out.

Figure 9:
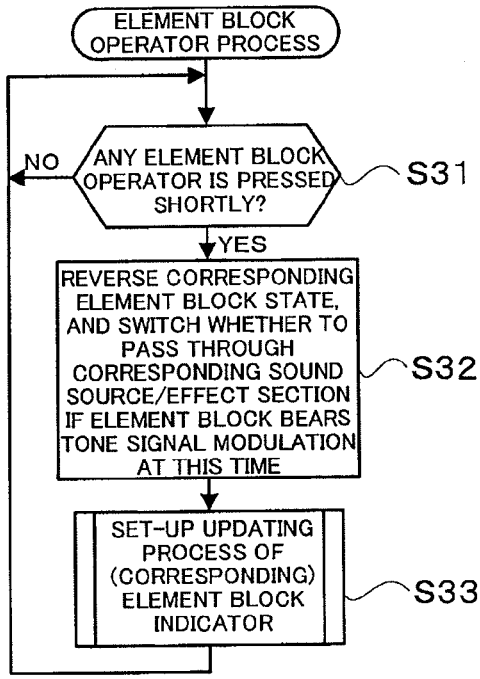
FIG. 9 is a flowchart showing one embodiment of an element block operator process.

FIG. 9 is a flowchart showing one embodiment of the "element block operator process" (see Step S17 of FIG. 7). At Step S31, it is determined whether any element block operating section 6B (piano element switch) of the piano element operator unit (see FIG. 4) is pressed (one push) for a short time that falls in a predetermined period of time or not. In the case where it is determined that no pressing operation of any element block operating section 6B for a short time is made ("NO" at Step S31), the CPU 1 waits for the process until a pressing operation of any element block operating section 6B for a short time is made. In the case where it is determined that a pressing operation of any element block operating section 6B for a short time is made ("YES" at Step S31), processes at Step S32 and Step S33 described below are carried out.

At Step S32, a setting state of effective/ineffective of the corresponding element block is reversed. At this time, in the case where the element block is one of its kind bearing a function to generate tone signals, tone signals are generated in the above "tone generating process" (the case of reversing to effective) or tone signals are not generated (the case of reversing to ineffective). Further, in the case where the element block is one of its kind bearing a function to modulate tone signals, it is switched whether the tone signal is caused to pass through without carrying out signal control by the corresponding signal processing section (that is, switched so as to cause the tone signal to pass through in the case of reversing to ineffective). At Step S33, the "set-up updating process for an element block indicator" (see FIG. 10, which will be described later) is carried out so as to turn on or off only the element block indicator 6A corresponding to the element block whose state is reversed between effective and ineffective. The processing flow then returns to the process at Step S31 after termination of these processes, the processes from Step S31 to S33 described above are carried out repeatedly.

Figure 10:
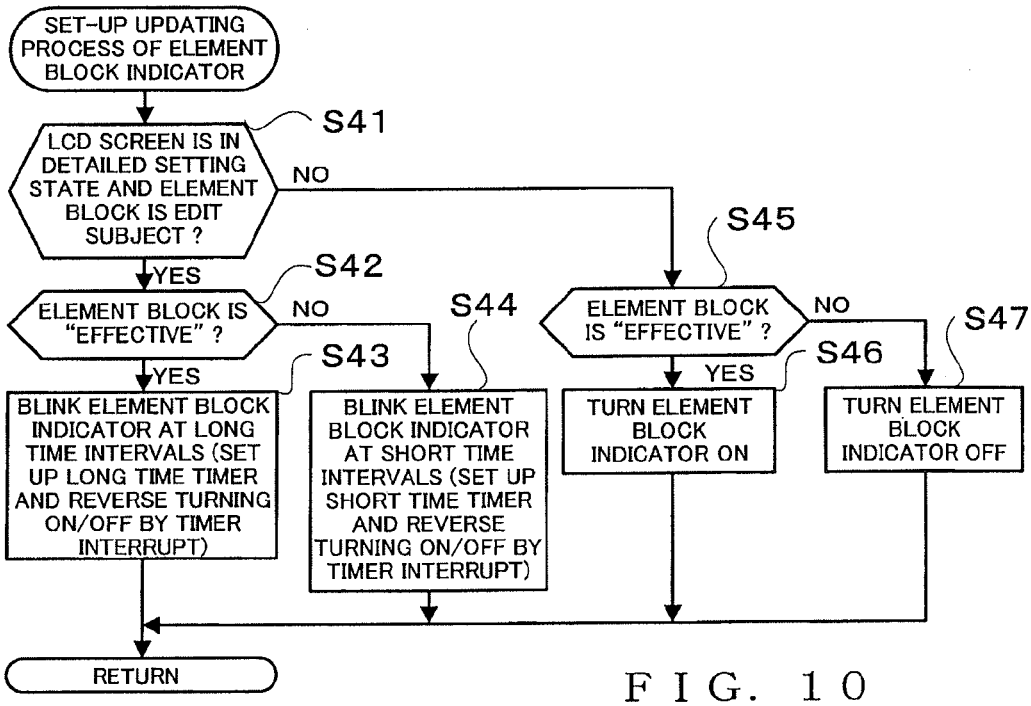
FIG. 10 is a flowchart showing one embodiment of a set-up updating process for an element block indicator.

FIG. 10 is a flowchart showing one embodiment of the "set-up updating process for element block indicators" (see Step S15 of FIG. 7 and Step S33 of FIG. 9). This process is a process to control to turn on, turn off and blink each of the element block indicators 6A of the piano element operator unit (see FIG. 4).

At Step S41, an LCD screen (display section 7) is a display screen (edit mode) shown in FIG. 5 in which detailed settings of the detailed parameter are possible, and it is determined whether the element block corresponding to the element block indicator 6A is an edit subject or not. In the case where the LCD screen is a display screen of an edit mode and it is determined that the element block corresponding to the element block indicator 6A is the edit subject ("YES" at Step S41), it is determined whether the element block is set up to "effective" or not (Step S42). In the case where it is determined that the element block is set up to "effective" ("YES" at Step S42), the element block indicator 6A is controlled so as to blink at long time intervals (Step S43). As one example, a long time timer is set up, and turning on/off may be reversed periodically by timer interrupt. In the case where it is determined that the element block is not set up to "effective", that is, in the case where it is set up to "ineffective" ("NO" at Step S42), the element block display 6A is controlled so as to periodically blink at short time intervals (Step S44). As one example, a short time timer is set up, and turning on/off may be reversed by timer interrupt. Thus, in the case where it is in the edit mode, it may be adapted so that the user can confirm whether the element block as the edit subject of the detailed parameter is in an effective state or an ineffective state by means of blink intervals of the element block indicator 6A (LED).

On the other hand, in the case where it is determined that the LCD screen (display section 7) is the display screen of the edit mode and the element block corresponding to the element block indicator 6A is not the edit subject ("NO" at Step S41), it is determined whether the element block is set up to "effective" or not (Step S45). In the case where it is determined that the element block is set up to "effective" ("YES" at Step S45), the corresponding element block indicator 6A is controlled so as to always be turned on (Step S46). In the case where it is determined that the element block is not set up to "effective" ("NO" at Step S45), the element block indicator 6A is controlled so as to be turned off (Step S47). Thus, in the case where it is not in the edit mode, it may be adapted so that the user can confirm whether tenement block as the edit subject of the detailed parameter is in the effective state or the ineffective state by means of turning on/off of the element block indicator 6A (LED).

Figure 11:
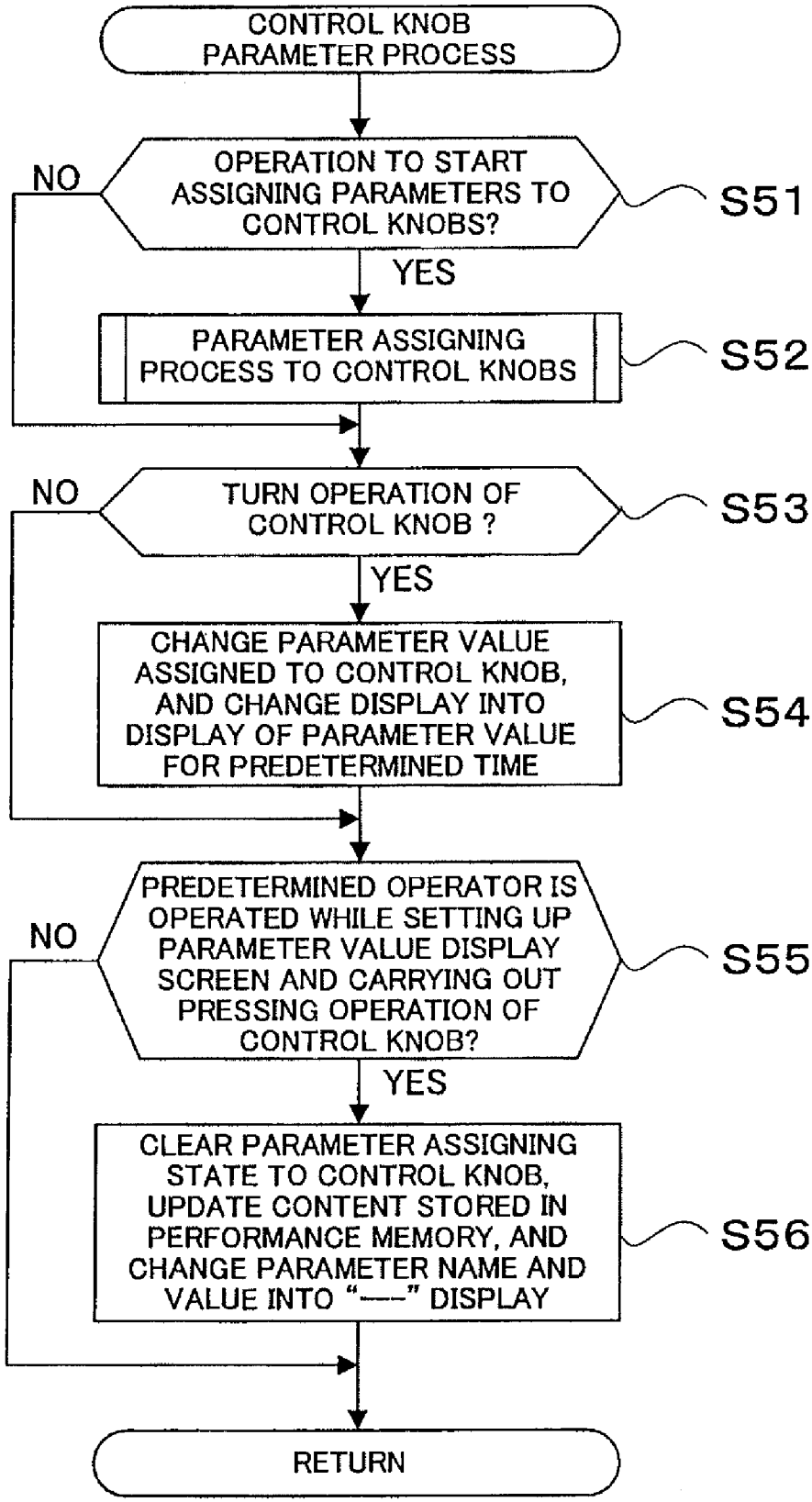
FIG. 11 is a flowchart showing one embodiment of a control knob parameter process.

FIG. 11 is a flowchart showing one embodiment of the "control knob parameter process" (see Step S2 of FIG. 6). At Step S51, it is determined whether an operation to start assigning parameters to the control knobs 8A (for example, operation of "ASSIGN" switch) is made or not. In the case where it is determined that the operation to start assigning the parameters to the control knobs 8A is made ("YES" at Step S51), the CPU 1 shifts to a parameter assigning mode and carries out a "parameter assigning process to the control knobs" (Step S52). At Step S53, it is determined whether a turn operation of the control knob 8A is made in a performance mode. In the case where it is determined that the turn operation of the control knob 8A is made ("YES" at Step S53), the CPU 1 changes a parameter value of the detailed parameter assigned to the control knob 8A, and changes display of a corresponding place on the display section 7 from display of the parameter name to display of the parameter value for a predetermined period of time (Step S54). In this regard, the parameter value changed by the operation of the control knob 8A may be written into the performance memory, or it may not be written into the performance memory because it deems a temporary value change at performance. Alternatively, it may be written only when there is an instruction to store the value by the user.

At Step S55, it is determined whether the display of the display section 7 is a display screen of the parameter value arbitrarily combined (that is, performance mode) and a predetermined operator (for example, "EXIT" switch) is operated while carrying out a pressing operation of the control knob 8A or not. In the case where it is determined that the display is the display screen of the parameter value and the predetermined operator is operated while carrying out the pressing operation of the control knob 8A ("YES" at Step S55), the CPU 1 clears the parameter assigning state to the control knob 8A, updates the content stored in the performance memory, and changes the display of the parameter name and the parameter value into display of "---" (Step S56).

Figure 12:
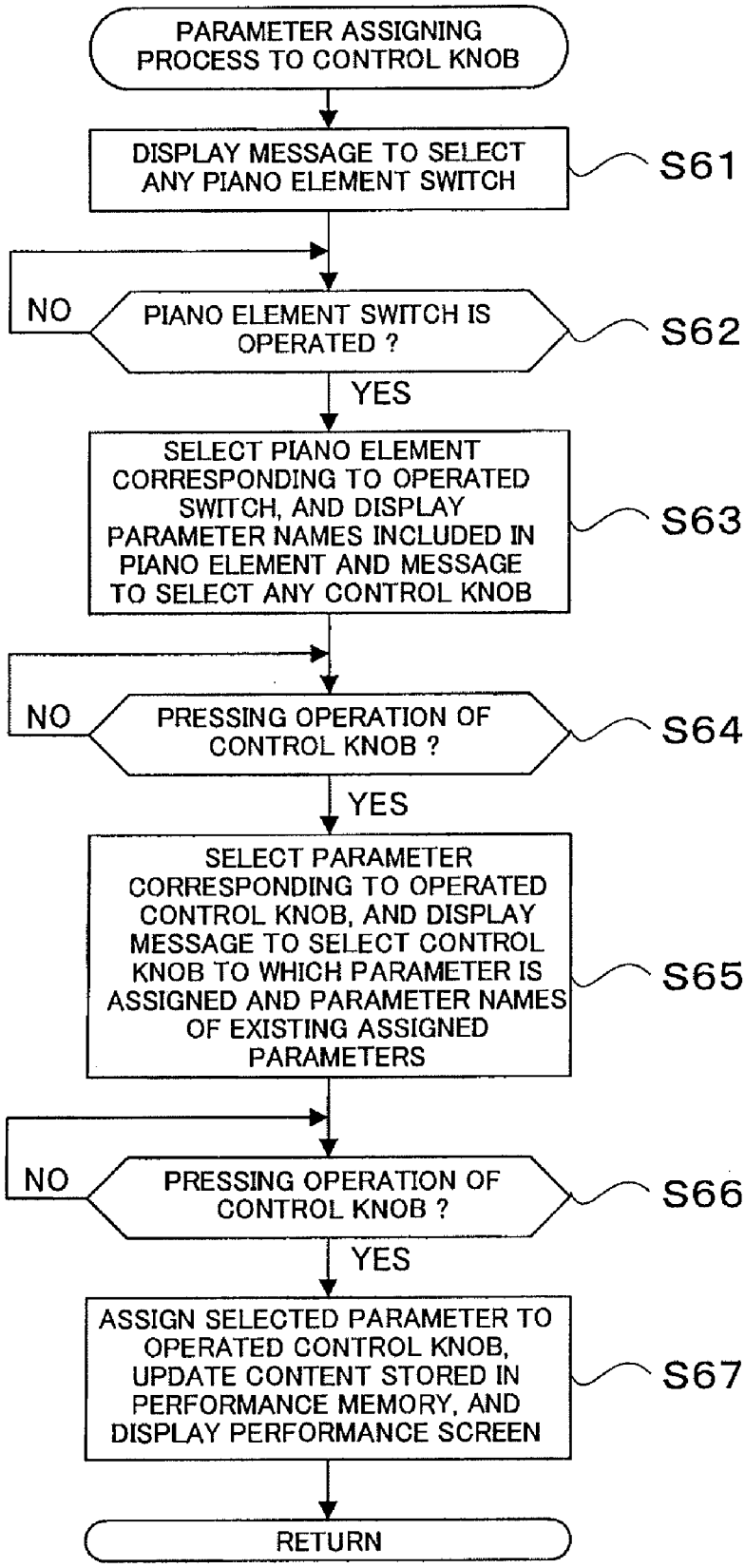
FIG. 12 is a flowchart showing one embodiment of a parameter assigning process to a control knob.

FIG. 12 is a flowchart showing one embodiment of the "parameter assigning process to control knobs" (see Step S52 of FIG. 11). At Step S61, a message to select any piano element switch is displayed. At Step S62, it is determined whether an operation of any piano element switch is made or not. In the case where it is determined that an operation of any piano element switch is not made ("NO" at Step S62), the CPU 1 waits for the process until an operation of any piano element switch is made. In the case where it is determined that an operation of any piano element switch is made ("YES" at Step S62), the CPU 1 selects an piano element corresponding to the operated switch, and causes the display section 7 to display a plurality of parameter names included in the piano element and a message to select any control knob 8A (Step S63).

At Step S64, it is determined whether a pressing operation against any control knob 8A is made or not. In the case where it is determined that a pressing operation of any control knob 8A is not made ("NO" at Step S64), the CPU 1 waits for the process until any pressing operation to the control knob 8A is made. In the case where it is determined that the pressing operation of any control knob 8A is made ("YES" at Step S64), the CPU 1 selects a parameter corresponding to the operated control knob 8A, and causes the display section 7 to display a message to cause the user to select a control knob assigned to the parameter and names of existing parameters to which the control knobs 8A have been assigned (Step S65). At Step S66, it is determined whether a pressing operation of the control knob 8A is made again or not. The CPU 1 waits for the process until the pressing operation of the control knob 8A is made again. In the case where it is determined that the pressing operation of the control knob 8A is made ("YES" at Step S66), the selected parameter is assigned to the operated control knob 8A, the content stored in the performance memory is updated, and a performance screen is displayed in the display section 7 (Step S67).

Figure 13A:
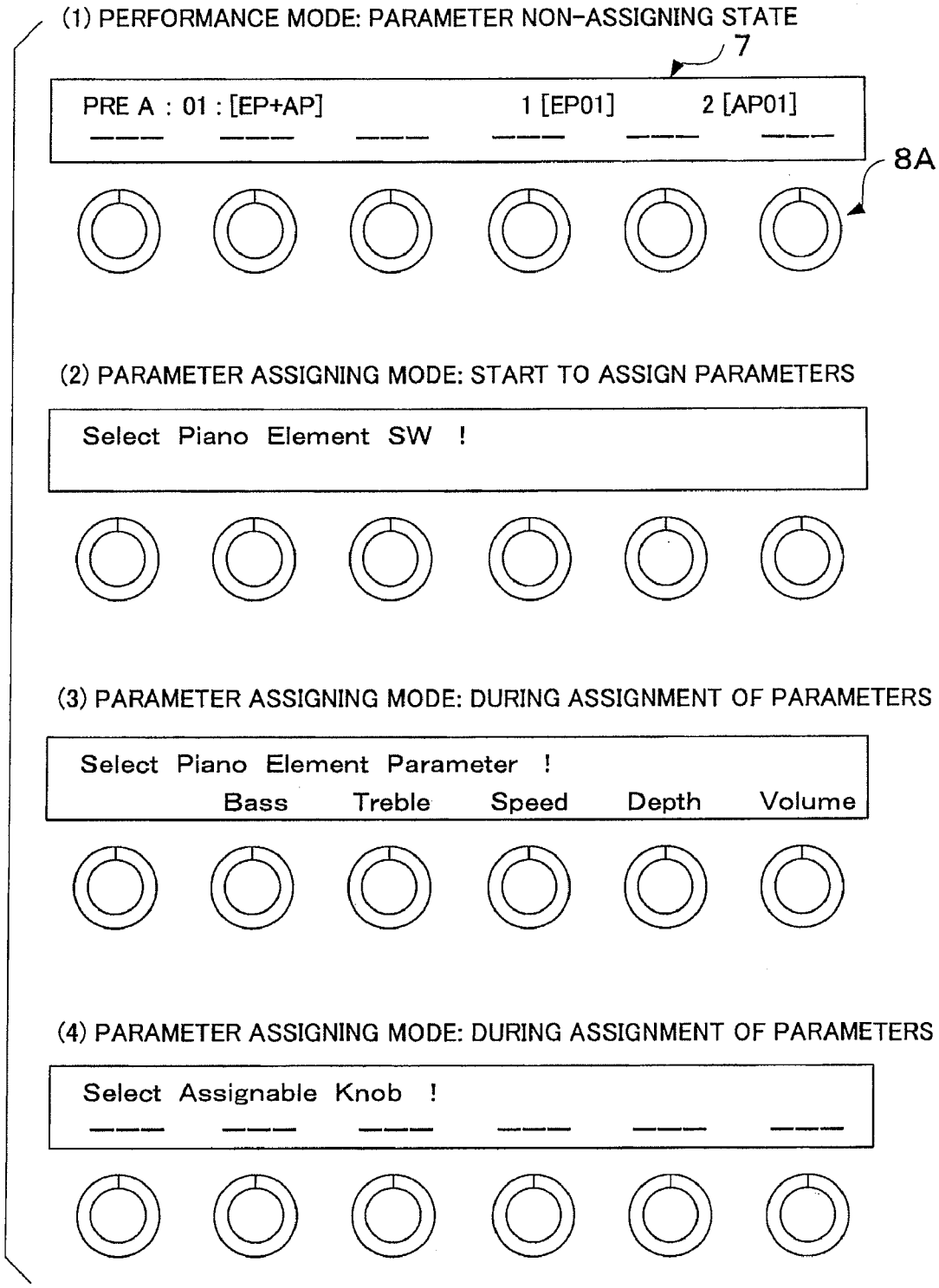
FIG. 13A is a first conceptual diagram for explaining concrete operational procedures and display content of the indicator at that time when a parameter is assigned to a control knob.

Here, concrete operational procedures and the display content of the display section 7 at that time on parameter assignment to the control knob 8A achieved with execution of the processes in FIG. 11 and FIG. 12 described above will be described using FIG. 13. Item (1) in FIG. 13A shows a display example of the case where the display of the display section 7 is first updated, in response to a predetermined operation, from the display screen shown in FIG. 5 to a display screen in which detailed parameter arbitrarily combined by the user is displayed and the display is in a parameter non-assigning state (initial state), in which the parameter has not been assigned yet, when to shift to a performance mode, in which the displayed detailed parameter can be changed. In this case, a performance memory name and a number (here, performance 1 data (01) of BANK A (PRE A) of preset bank), a performance data name (EP+AP), and a voice name (EP01, AP01) of each layer data included in the performance data for specifying one performance data that creates a group of parameters combined arbitrarily are displayed in order from the left of an upper line side of the display section 7. At this time, "---" indicating that no parameter is assigned to each of the control knobs 8A is displayed at a lower line side of the display section 7.

At the display state of the above Item (1), by operating a predetermined operator (for example, "ASSIGN" switch) of other operator units, parameter assign setting to the control knob 8A is started (it shifts from the performance mode to the parameter assigning mode). As shown in Item (2) in FIG. 13A, a message to "select any piano element switch" (in the drawing, "Select Piano Element SW") is first displayed. In this regard, all of the LEDs in the vicinity of the piano element switches shown in FIG. 4 are caused to blink at this time.

Next, when any of a plurality of piano element switches [PIANO], [PRE-AMPLIFIER], [MODULATION EFFECT] and [POWER-AMPLIFIER/COMPRESSOR] is operated, detailed parameters in the element block are listed up in the vicinity of each control knob. For example, Item (3) in FIG. 13A shows the display content when the [PRE-AMPLIFIER] switch is pressed in the case where each element block of the Layer 1 data is assigned as the piano element switch. As shown in the drawings, in this case, a message to "select any parameter" is displayed at an upper line side, and a large number of parameter names included in the parameter information assigned to the operated piano element switch are displayed in a lower line side so as to blink. Here, five kinds of parameters (parameters 1 to 5) whose names are respectively Bass, Treble, Speed, Depth and Volume are displayed.

When the control knob 8A corresponding to any parameter display is operated (for example, when a switch of a second control knob 8A from the left is pressed), the parameter (Bass) displayed so as correspond to the control knob 8A is selected, a message to prompt the user to "select the control knob 8A to which the parameter is assigned" is displayed. Item (4) in FIG. 13A shows the display content in that case. In this regard, in the case where there is a control knob 8A to which a parameter has already been assigned in six pieces of control knobs 8A, the assigned parameter is displayed at a position corresponding to the control knob 8A.

When any of the control knobs 8A to which parameters have not been assigned yet (for example, the control knob at a left end) is operated (when a switch of the control knob 8A is pressed), the selected parameter (Bass parameter in preamplifier parameter information of Layer 1) is assigned to the control knob 8A, as shown in Item (5) in FIG. 13B, the display is returned to the display content before shifting to the parameter assigning mode shown in Item (1) in FIG. 13A (it shifts from the parameter assigning mode to the performance mode). However, as described above, Bass parameter of Layer 1 is assigned to the control knob 8A at the left end. For this reason, Item (5) in FIG. 13B is different from Item (1) in FIG. 13A, and "1 Bass", which is a parameter assigned to a lower line side of the left end in the display section 7 is displayed. In this regard, the number "1" displayed at the left of the parameter name "Bass" indicates a layer to which the parameter belongs. When the control knob at the left end is turned (or rotated) at this state, a value of the parameter with the name "Bass" in the preamplifier parameter information of Layer 1 is changed.

By repeatedly carrying out Items (2) to (5) described above, it is possible to assign parameters to all control knobs 8A of the parameter operator unit (see Item (6) in FIG. 13B). When the control knob 8A to which the parameter is assigned is subjected to a turn operation in a display state of Item (6) in FIG. 13B, a parameter value of the assigned parameter is changed. At that time, since the display corresponding to the operated control knob 8A is switched from the parameter name to the parameter value, the user can visually confirm the parameter value in response to an operation of the control knob 8A. In this regard, in the parameters assigned to the six pieces of control knobs 8A, parameters included in two layer data (Layer 1, Layer 2) may be mixed. Further, there is no need to assign parameters to all of the control knobs 8A, and there may be a control knob 8A to which any parameter has not been assigned yet.

Item (7) in FIG. 13B shows a state where the second control knob 8A from the left is operated, a parameter value of "Decay" parameter of Layer 1 is changed and the parameter value Item (100) is displayed. In this regard, the displayed parameter value may be displayed by an absolute value, or may be displayed by a relative value from a reference value. In this regard, after a predetermined period of time is elapsed since a turn operation of the control knob 8A is terminated, the display is returned to the display of the original parameter name.

By means of operations of a predetermined operator (for example, page switching "PAGE CHG" switch) in other operating section, as shown in Item (8) in FIG. 13B, it is possible to switch a state where the parameter name and the current parameter value assigned to each of the control knobs 8A are displayed at the same time. Then, when a predetermined operator (for example, "EXIT" switch) of other operator unit is operated while operating the control knob 8A for which the user wants to clear parameter assignment at this display state (pressing the switch of the control knob 8A), the parameter assignment to the control knob 8A is cleared. In Item (8) in FIG. 13B, parameter assignment to a third control knob 8A from the left is cleared, and "---" indicating that a parameter is not assigned to the control knob 8A is accordingly display at corresponding portions in each of the upper and lower lines of the display section 7.

Figure 14:
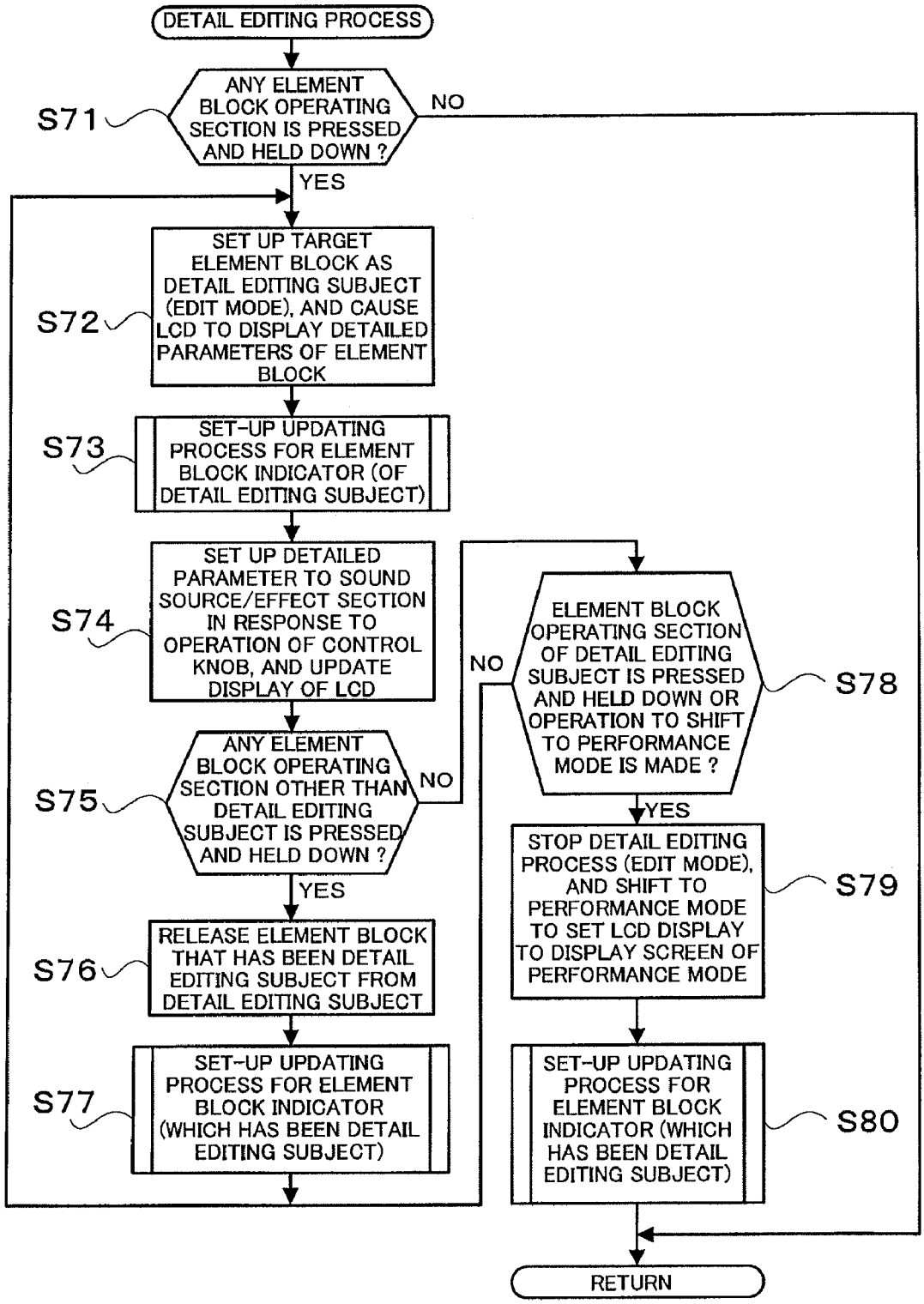
FIG. 14 is a flowchart showing one embodiment of a detail editing process.

FIG. 14 is a flowchart showing one embodiment of the "detail editing process" (see Step S3 of FIG. 6). At Step S71, it is determined whether any element block operating section 6B is operated so as to be pressed and held down or not. In the case where it is determined that no element block operating section 6B is operated so as to be pressed and held down ("NO" at Step S71), the CPU 1 terminates this process.

On the other hand, in the case where it is determined that any element block operating section 6B is operated so as to be pressed and held down ("YES" at Step S71), the CPU 1 sets a target element block as a detail editing subject (shifts to an edit mode), and causes the display section 7 (LCD) to display detailed parameters of the element block (Step S72). In this case, the detailed parameters are associated with the respective control knobs 8A. At Step S73, the "set-up updating process for an element block indicator" (see FIG. 10) is carried out with respect to the element block of the detail editing subject. This causes the corresponding element block indicator 6A to blink at either long time intervals or short time intervals. At Step S74, a parameter value of the corresponding detailed parameter is set up to the sound source/effect section 10 in response to an operation of the control knob 8A, and corresponding display of the parameter value in the display section 7 is updated.

At Step S75, it is determined whether any element block operating section 6B other than the detail editing subject is operated so as to be pressed and held down or not. In the case where it is determined that any element block operating section 6B other than the detail editing subject is operated so as to be pressed and held down ("YES" at Step S75), the CPU 1 releases the element block that has been the detail editing subject from the detail editing subject (Step S76). At Step S77, the "set-up updating process for an element block indicator" (see FIG. 10) is carried out for the element block released from the detail editing subject. Thus, the corresponding element block indicator 6A is caused to be turned on or off. Then, the processing flow returns to the process at Step S72.

In the case where it is determined that no element block operating section 6B other than the detail editing subject is operated so as to be pressed and held down ("NO" at Step S75), it is determined whether the element block operating section 6B of the detail editing subject is pressed and held down or not, or an operation to shift to a performance mode (for example, an operation of a predetermined operator) is made or not (Step S78). In the case where it is determined that the element block operating section 6B of the detail editing subject is not pressed and held down and the operation to shifts to the performance mode is not made ("NO" at Step S78), the processing flow returns to the process at Step S72. On the other hand, in the case where it is determined that the element block operating section 6B of the detail editing subject is pressed and held down or the operation to shifts to the performance mode is made ("YES" at Step S78), the CPU 1 stops the detail editing process, and shifts to the performance mode from the edit mode to set the LCD display to a display screen of the performance mode (Step S79). At Step S80, the "set-up updating process for an element block indicator" (see FIG. 10) is carried out with respect to the element block that are the detail editing subject. This causes the corresponding element block indicator 6A to be turned on or off.

Figure 15:
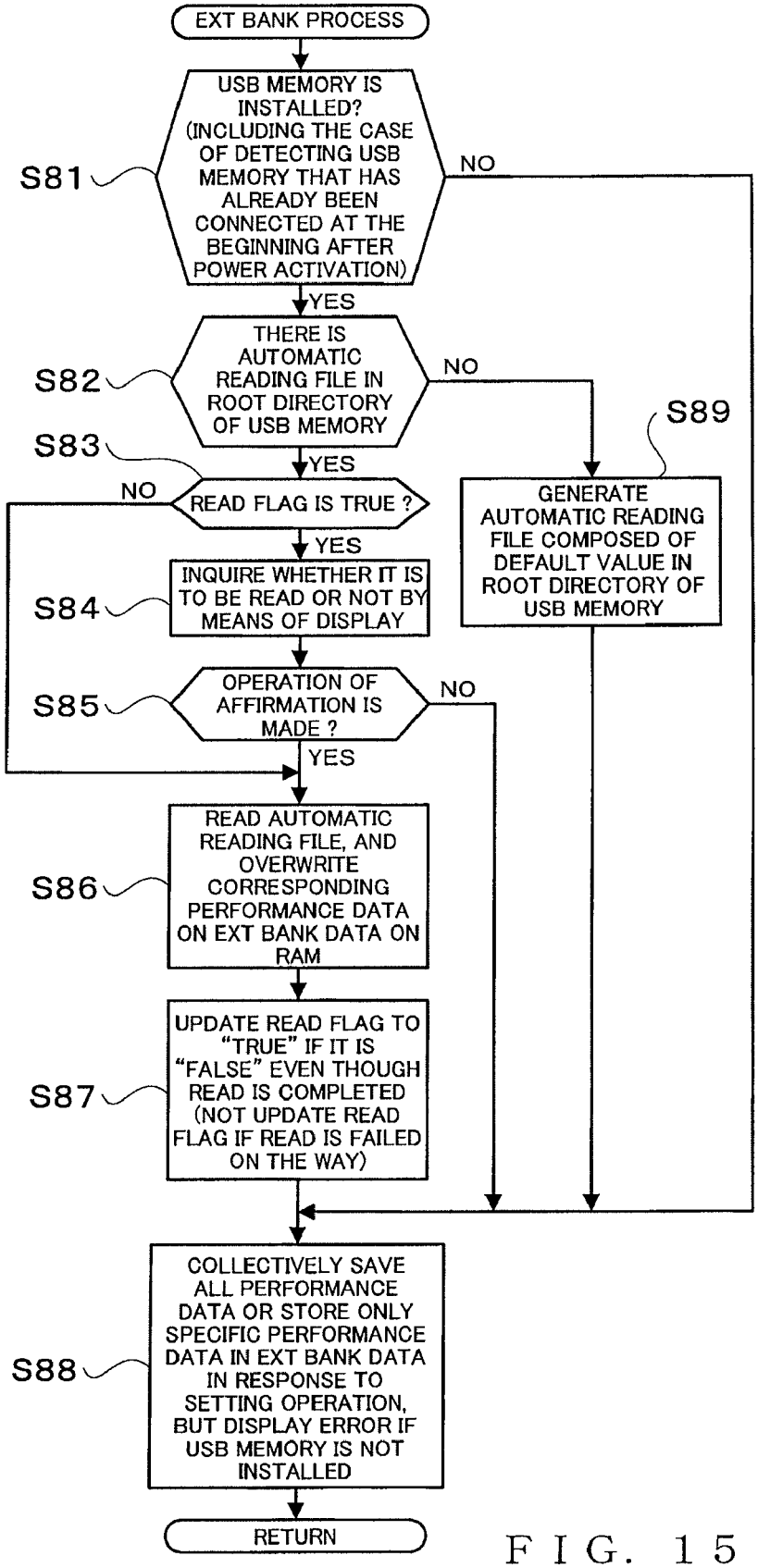
FIG. 15 is a flowchart showing one embodiment of an EXT bank process.

FIG. 15 is a flowchart showing one embodiment of the "EXT bank process" (see Step S4 of FIG. 6). At Step S81, it is determined whether a transportable storage media M (for example, USB memory) is attached to (inserted into) the transportable storage media slot 5 or not. This determination includes the case of carrying out detection of a USB memory, which has already been connected, at the beginning after power activation. In the case where it is determined that a USB memory is not attached to (inserted into) the transportable storage media slot 5 ("NO" at Step S81), the processing flow jumps to a process at Step S88. However, even in the case where no USB memory is attached to (inserted into) the transportable storage media slot 5, EXT bank data in the performance memory on the RAM 3 is created by writing a default value (the initial setting of the performance memory as described above). Needless to say, it is possible to arbitrarily select the performance data in the EXT bank data created in this manner for tone creation. Of course, it is also possible to edit it. However, since a USB memory is not attached (inserted), an alert warning of "no device" is to be displayed even when to carry out collective save (SAVE) of the EXT bank data or storage (STORE) of only the specific performance data (see Step S88, which will be described later).

In the case where it is determined that a USB memory is attached to (inserted into) the transportable storage media slot 5 ("YES" at Step S81), it is determined whether an automatic reading file is stored in a root directory of the USB memory (Step S82). The automatic reading file is the EXT bank data (file), and a storage source has the same name and the same data configuration as those of a storage destination. In the case where it is determined that no automatic reading file is stored in the root directory of the inserted USB memory ("NO" at Step S82), the CPU 1 generates (or stores) the EXT bank data (automatic reading file) created in the performance memory on the RAM 3 and composed of the default value in the root directory of the USB memory (Step S89), and jumps to the process at Step S88.

At Step S83, it is determined whether a read flag is "TRUE (read)" or not. In the case where the read flag is "TRUE" ("YES" at Step S83), the CPU 1 again reads the automatic reading file that has already read, and inquires of the user about whether it is to be overwritten in the performance memory by means of display (Step S84). Then, at Step S85, it is determined whether an operation to instruct affirmation (that is, read) is made by a user operation or not. In the case where it is determined that the operation to instruct affirmation (read) is not made by the user operation ("NO" at Step S85), the CPU 1 jumps to the process at Step S88. In the case where it is determined that the operation to instruct affirmation (read) is made by the user operation ("YES" at Step S85), the CPU 1 reads the automatic reading file from the USB memory, and overwrites the plurality of performance data thus read on each of the performance data of the EXT bank data in the performance memory held on the RAM 3 in advance (Step S86).

At Step S87, in the case where the read flag is "FALSE (not read)" even though the read of the automatic reading file is completed, the CPU 1 updates it to "TRUE" (Step S87). However, in the case where the CPU 1 fails the read of the automatic reading file, the CPU 1 does not update the read flag to "TRUE". At Step S88, in response to the setting operation by the user, the EXT bank data in the performance memory are collectively saved (SAVE) or only the specific performance data are stored (STORE) in the USB memory attached to (inserted into) the transportable storage media slot 5. However, in the case where the USB memory is not installed to the transportable storage media slot 5 at this time, the CPU 1 causes the display section 7 to display an error, thereby warning the user of it.

According to the above "EXT bank process", in the case where the EXT bank data are stored in the root directory of the inserted USB memory when the inserted USB memory is picked out of the transportable storage media slot 5 once and is installed again during power activation, the read flag becomes "TRUE" by referring to it. For this reason, automatic reading is started after the user is confirmed "whether it may be automatically read or not".

Further, in the case where the EXT bank data are copied between different USB memories, original EXT bank data are stored in the performance memory on the RAM 3 by inserting a USB memory in which the original EXT bank data are stored to the transportable storage media slot 5. In the case where another USB memory is attached to (inserted into) the transportable storage media slot 5, the CPU 1 responds to the inquiry of the displayed automatic reading as "not automatically read", and SAVE or STORE the EXT bank data in the performance memory on the RAM 3 into the replaced (or switched) USB memory.

Figure 16:
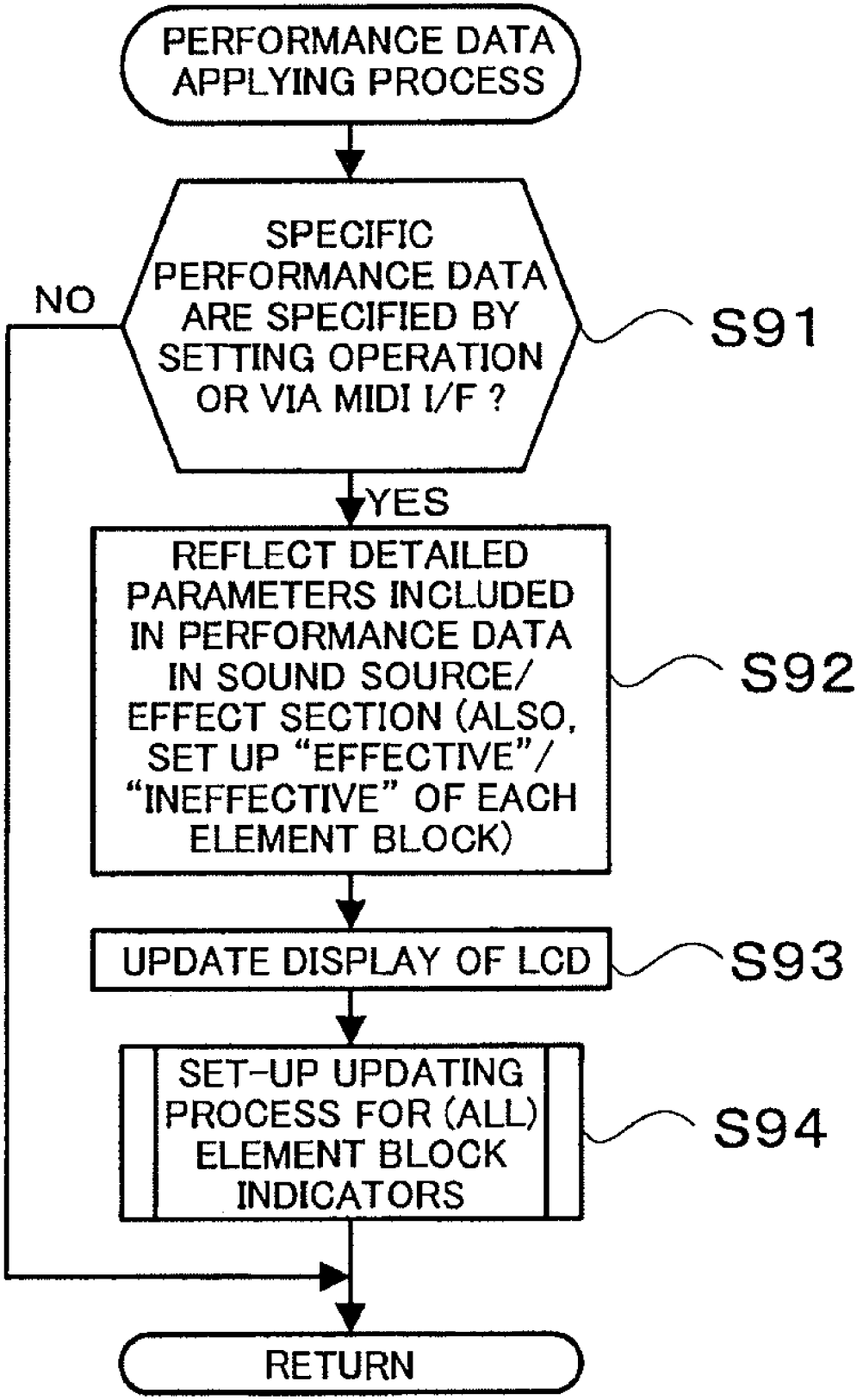
FIG. 16 is a flowchart showing one embodiment of a performance data applying process.

FIG. 16 is a flowchart showing one embodiment of the "performance data applying process" (see Step S5 of FIG. 6). At Step S91, it is determined whether or not the specific performance data are specified by means of a setting operation of the set-up operator 8A for selecting performance data or via the MIDI interface. In the case where it is determined that the specific performance data are not specified ("NO" at Step S91), the CPU 1 terminates this process. In the case where it is determined that the specific performance data are specified ("YES" at Step S91), the CPU 1 reflects all detailed parameters included in the performance data in the sound source/effect section 10 (Step S92). In this case, "effective or ineffective" is set up to each of the element blocks on the basis of effective/ineffective flags. At Step S93, display of the display section 7 (LCD) is updated. At this time, the display regarding the detailed parameter of the parameter information specified as default in the plural kinds of parameter information contained in the selected performance data is also reflected to the display section 7 (LCD) (see FIG. 5: the display screen of the edit mode). At Step S94, the "set-up updating process for an element block indicator" (see FIG. 10) is carried out with respect to all of the element blocks. This causes all of the element block indicators 6A to be turned on or off on the basis of the "effective/ineffective" setting.

As described above, the tone signal creating apparatus according to the present invention is adapted as follows. In the case where the element block operators 6B associated with the respective element blocks are operated so as to be pressed shortly, the signal control process of the element block associated with the operated element block operating section 6B is switched between effective and ineffective at every operation. On the other hand, in the case where the element block operating section 6B is operated so as to be pressed and held down, the element block associated with the operated element block operating section 6B is set up as the detail editing subject to be displayed in the display section 7 and associate the detailed parameter with the control knob 8A. Thus, settings of the detailed parameters can be carried out by means of the control knob 8A. Therefore, since switching between the setting of effective/ineffective of the element block and the setting of the detailed parameter for determining characteristics of the element block is carried out on the basis of the operation mode of the element block operating section 6B, it is possible to provide the device by which the user can produce sound while setting up effective/ineffective of the element block with effective/ineffective of the individual detailed parameters kept without costs.

Further, the tone signal creating apparatus according to the present invention is an apparatus capable of automatically reading and using the automatic reading file (EXT bank data) stored in the transportable storage media (USB memory), wherein automatic reading can be denied in the case where the user does not desire to restore (or return) the automatic reading file that has already been read to an original state by means of overwriting without deteriorating convenience for automatic reading. Namely, an automatic reading file is automatically read in the performance memory on the RAM 3 immediately from the USB memory that is detected at first after power activation. However, in the case where another USB memory is attached to (inserted into) the apparatus and detected after the previously-attached (inserted) USB memory has been removed, inquiry about confirmation is made for the user and an automatic reading file is read or not read from the USB memory in accordance with its response. This makes it possible to prevent the user from unexpectedly overwriting and restoring edited EXT bank data to an original state. Further, it is possible to write EXT bank data edited by the user into a USB memory attached to the apparatus after automatic reading without modification. Namely, data copy can easily be carried out between the USB memories. In this regard, needless to say, the large number of performance data contained in the EXT bank data read from the USB memory to the performance memory on the RAM 3 can be use by switching and selecting appropriately.

Moreover, the tone signal creating apparatus according to the present invention is adapted to be able to arbitrarily combine the detailed parameters that has been contained in different element blocks in advance by means of the parameter assignment. Thus, when detailed parameters included in a different element block are to be set up, the user can easily set up the detailed parameters included in the different element block by calling the detailed parameters included in the different element block by means of a simple operation at one time and operating the control knob 8A without complicated procedures in which an edit mode is repeatedly set up for every different element block and only detailed parameters included in each of the element blocks is in turn set up by operating the control knob 8A. In particular, during the performance in real time, it is very convenient for the user because detailed parameters of different element blocks are read out instantaneously to be set up.

In this regard, in the parameter assigning mode described above, the operation procedures when to assign the parameters to the respective control knobs 8A are not limited to one illustrated in FIG. 13A and FIG. 13B. For example, a control knob to which a parameter is to be assigned may be selected at the beginning, and selection of a piano element and selection of a parameter may be made. Further, the display content to be displayed in the display section 7 is not limited to one illustrated above. If a larger high resolution indicator can be adopted, wizard display of the operation procedures may be made graphically.

In this regard, in the parameter assigning mode, in order to guide a switch to be operated and the like, an LED of a target switch or display in the screen may be controlled so as to have a different form (blinking or the like) from the other ones.

In this regard, clear of the parameter assigning state is not limited to the operation of the predetermined operator (EXIT switch) while operating the control knob 8A as described above, and may be an operation of the control knob while operating a predetermined operator. Alternatively, it may be other operation form.

In this regard, the parameter assigning state to each of the control knobs 8A is not limited to one in which a state that a parameter is not assigned is defined as default. Parameters suitable for each performance may be assigned in advance.

In this regard, the operators to which the parameters are assigned are not limited to the control knobs 8A, and may be other type of operators such as sliders.

In this regard, switching of effective/ineffective of each of the element blocks by subjecting the element block operating section 6B of the piano element operator unit to a short pressing operation can be carried out at both the edit mode and the performance mode.

In this regard, the electronic musical instrument described above is not limited to a form of keyboard instruments, and it may have any type of form such as percussion instruments and wind instruments.

In this regard, in the embodiment described above, the blinking interval of the corresponding LED has been differentiated depending upon whether the element block at the edit state is effective or ineffective, but the LED may have other display mode. For example, a ratio between time to be turned on and time to be turned off may be changed as follows. In the case where the element block at the edit state is effective, the LED is turned on for 0.4 seconds and turned off for 0.1 seconds. On the other hand, in the case where it is ineffective, the LED is turned on for 0.1 seconds and turned off for 0.4 seconds. Further, in the embodiment described above, the four states of the element block have been expressed with turned-on, turned-off, long interval blinking and short interval blinking as the display modes of the LED, but they are not limited thereto. For example, they may be expressed on the basis of a difference of brightness, expressed on the basis of a color using a multicolor LED. Alternatively, a double LED pairing two LEDs is provided in each of the element blocks, and they may be expressed on the basis of combination of displays of the two LEDs.

Moreover, in the embodiment described above, the process to switch effective/ineffective of the element block and the process to set up to or release from the edit subject have been changed depending upon whether the pressing operation of the element block operator is made shorter or longer than the predetermined time, but they may be other operation modes. For example, the process may be changed depending upon only one pressing operation or two pressing operations within a predetermined time, that is, so-called a single click or a double click.

What is claimed is:

1. A tone signal creating apparatus comprising a plurality of element blocks each handling any of signal control processes including at least tone signal generation, signal amplification and effect impartment to accomplish a sequence of the signal control processes based on a combination of the signal control processes handled by the respective element blocks, the tone signal creating apparatus being capable of creating various tone signals in accordance with the combination of the signal control processes of the respective element blocks, the tone signal creating apparatus further comprising:

a storage section for storing plural kinds of detailed parameters for each of the plurality of element blocks, said storage section comprising a RAM;

an attachment section for detachably attaching a transportable storage device;

a detecting section for detecting whether a transportable storage device is attached to the attachment section or not;

an updating section that reads, when the detecting section detects that the transportable storage device is attached to the attachment section, an automatic reading file composed of plural kinds of detailed parameters having stored in the detected transportable storage device, and collectively updates the plural kinds of detailed parameters stored in the storage section by the read automatic reading file, said updating section determining, in accordance with a user's instruction, whether the collectively updating based on a currently-read automatic reading file should be carried out or not in the case where an automatic reading file has already been read by the updating section;

saving control section that stores one or more detailed parameters, stored in said storage section, into a non-volatile memory, a generating section that generates an automatic reading file composed of default detailed parameters prepared in advance, and stores the generated automatic reading file in the transportable storage device in the case where the automatic reading file is not stored in the transportable storage device whose attachment to the attachment section is detected by the detecting section; and a writing section that writes all or a part of the plural kinds of detailed parameters for each of the element blocks stored in the storage section into the generated automatic reading file stored in the transportable storage device, wherein the plurality of element blocks carry out any signal control process of the at least tone signal generation, signal amplification and effect impartment on the basis of the plural kinds of detailed parameters for each of the element blocks stored in the storage section.

2. The tone signal creating apparatus as claimed in claim 1, wherein said non-volatile memory is a transportable storage device detachably attachable to the attachment section.

3. A computer-implemented method of creating tone signals, the method comprising:

storing plural kinds of detailed parameters in a storage section for each of a plurality of element blocks, each of the plurality of element blocks handling any of signal control processes including at least tone signal generation, signal amplification and effect impartment to accomplish a sequence of the signal control processes based on a combination of the signal control processes handled by the respective element blocks, said storage section comprising a RAM;

detecting whether a transportable storage device is attached to an attachment section or not;

reading, upon detection of attachment of the transportable storage device to the attachment section, an automatic reading file composed of plural kinds of detailed parameters having stored in the detected transportable storage device, collectively updating the plural kinds of detailed parameters stored in the storage section by the read automatic reading file, and controlling to determine, in accordance with a user's instruction, whether the collectively updating based on the currently-read automatic reading file should be carried out or not in the case where an automatic reading file has already been read;

carrying out any signal control process of the at least tone signal generation, signal amplification and effect impartment on the basis of the plural kinds of detailed parameters for each of the plurality of element blocks stored in the storage section; and saving one or more detailed parameters, stored in said storage section, into a non-volatile memory;

generating an automatic reading file composed of default detailed parameters prepared in advance and storing the generated automatic reading file in the transportable storage device in the case where the automatic reading file is not stored in the transportable storage device whose attachment to the attachment section has been detected; and writing all or a part of the plural kinds of detailed parameters for each of the element blocks stored in the storage section into the generated automatic reading file stored in the transportable storage device.

4. The computer-implemented method as claimed in claim 3, wherein said non-volatile memory is a transportable storage device detachably attachable to the attachment section.

5. A non-transitory computer-readable storage medium containing a group of instructions for causing a computer to execute a method of creating tone signals, the method comprising:

storing plural kinds of detailed parameters in a storage section for each of a plurality of element blocks, each of the plurality of element blocks handling any of signal control processes including at least tone signal generation, signal amplification and effect impartment to accomplish a sequence of the signal control processes based on a combination of the signal control processes handled by the respective element blocks, said storage section comprising a RAM;

detecting whether a transportable storage device is attached to an attachment section or not;

reading, upon detection of attachment of the transportable storage device to the attachment section, an automatic reading file composed of plural kinds of detailed parameters having stored in the detected transportable storage device, collectively updating the plural kinds of detailed parameters stored in the storage section by the read automatic reading file, and controlling to determine, in accordance with a user's instruction, whether the collectively updating based on the currently-read automatic reading file should be carried out or not in the case where an automatic reading file has already been read;

carrying out any signal control process of the at least tone signal generation, signal amplification and effect impartment on the basis of the plural kinds of detailed parameters for each of the plurality of element blocks stored in the storage section; and saving one or more detailed parameters, stored in said storage section, into a non-volatile memory;

generating an automatic reading file composed of default detailed parameters prepared in advance, and storing the generated automatic reading file in the transportable storage device in the case where the automatic reading file is not stored in the transportable storage device whose attachment to the attachment section has been detected; and writing all or a part of the plural kinds of detailed parameters for each of the element blocks stored in the storage section into the generated automatic reading file stored in the transportable storage device.

6. The non-transitory computer-readable storage medium as claimed in claim 5, wherein said non-volatile memory is a transportable storage device detachably attachable to the attachment section.

* * * * *